US008123448B2

(12) United States Patent
Todaro et al.

(10) Patent No.: US 8,123,448 B2
(45) Date of Patent: Feb. 28, 2012

(54) APPARATUS AND METHODS FOR AUTOMATICALLY BINDING A STACK OF SHEETS WITH A NONSPIRAL BINDING ELEMENT

(75) Inventors: Frank Todaro, Old Saybrook, CT (US); Peter Hotkowski, Chester, CT (US); James T. Russo, Chicago Heights, IL (US); Thomas T. Battisti, Buffalo Grove, IL (US)

(73) Assignee: General Binding Corporation, Lincolnshire, IL (US)

( * ) Notice: Subject to any disclaimer, the term of this patent is extended or adjusted under 35 U.S.C. 154(b) by 896 days.

(21) Appl. No.: 12/063,835

(22) PCT Filed: Aug. 4, 2006

(86) PCT No.: PCT/US2006/030410

§ 371 (c)(1),
(2), (4) Date: Jul. 15, 2008

(87) PCT Pub. No.: WO2007/021578

PCT Pub. Date: Feb. 22, 2007

(65) Prior Publication Data

US 2008/0298881 A1 Dec. 4, 2008

Related U.S. Application Data

(60) Provisional application No. 60/709,710, filed on Aug. 18, 2005, provisional application No. 60/708,579, filed on Aug. 16, 2005.

(51) Int. Cl.

| | |
|---|---|
| ***B42C 9/00*** | (2006.01) |
| ***B42B 5/08*** | (2006.01) |
| ***B42B 5/10*** | (2006.01) |
| ***B42B 9/00*** | (2006.01) |

(52) U.S. Cl. ..... 412/7; 412/6; 412/8; 412/38; 412/39; 412/40; 412/41

(58) Field of Classification Search ..... 412/6–8, 412/14, 24, 38–41; 281/27.1
See application file for complete search history.

(56) References Cited

U.S. PATENT DOCUMENTS

| | | | |
|---|---|---|---|
| 699,290 | A | 5/1902 | Daniel |
| 754,791 | A | 3/1904 | Mentzer |
| 1,005,423 | A | 10/1911 | Elder |
| 1,119,786 | A | 12/1914 | Morden et al. |

(Continued)

FOREIGN PATENT DOCUMENTS

| | | |
|---|---|---|
| CA | 509621 | 2/1955 |

(Continued)

*Primary Examiner* — Dana Ross
*Assistant Examiner* — Kyle Grabowski
(74) *Attorney, Agent, or Firm* — Michael Best & Friedrich LLP

(57) ABSTRACT

The present invention includes an automated binding machine configured for binding a stack of perforated sheets with a binding element. The automated binding machine includes a support member supporting the stack of perforated sheets, a binding element feeder, a plurality of binding elements supported by the binding element feeder, a receiving member configured to receive a first binding element from the plurality of binding elements and to insert at least a portion of the first binding element through the stack of perforated sheets, and a binding mechanism configured to engage the inserted portion and couple the inserted portion to a non-inserted portion of the first binding element.

31 Claims, 33 Drawing Sheets

U.S. PATENT DOCUMENTS

| | | | | | |
|---|---|---|---|---|---|
| 1,343,103 | A | | 6/1920 | Wolf | |
| 1,537,675 | A | | 5/1925 | Horn | |
| 1,816,021 | A | | 7/1931 | Meyerson | |
| 1,970,285 | A | | 8/1934 | Douvry | |
| 2,099,881 | A | | 11/1937 | Emmer | |
| 2,112,389 | A | | 3/1938 | Trussell | |
| 2,139,480 | A | | 12/1938 | Young | |
| 2,170,147 | A | | 8/1939 | Lane | |
| 2,200,877 | A | * | 5/1940 | Farkas | 412/38 |
| 2,206,394 | A | | 7/1940 | Farkas | |
| 2,242,185 | A | | 5/1941 | Spinner | |
| 2,311,090 | A | | 2/1943 | Schade | |
| 2,314,204 | A | | 3/1943 | Fontecilla | |
| 2,322,180 | A | | 6/1943 | Vernon | |
| 2,328,416 | A | | 8/1943 | Blizard et al. | |
| 2,363,848 | A | | 11/1944 | Emmer | |
| 2,367,687 | A | | 1/1945 | Phillips | |
| 2,374,803 | A | | 5/1945 | Broadwell | |
| 2,407,656 | A | * | 9/1946 | Emmer | 281/27.1 |
| 2,435,848 | A | | 2/1948 | Schade | |
| 2,459,541 | A | | 1/1949 | Russell | |
| 2,466,451 | A | | 4/1949 | Liebman | |
| 2,489,706 | A | | 11/1949 | Emmer | |
| 2,502,493 | A | | 4/1950 | Trussell | |
| 2,571,525 | A | | 10/1951 | Blitstein | |
| 2,582,953 | A | | 1/1952 | Bender | |
| 2,629,382 | A | | 2/1953 | Gomez | |
| 2,664,897 | A | | 1/1954 | Derringer | |
| 2,779,987 | A | | 2/1957 | Jordan | |
| 2,930,054 | A | * | 3/1960 | Bardy | 412/7 |
| 3,038,180 | A | * | 6/1962 | Levitan | 412/41 |
| 3,038,181 | A | * | 6/1962 | Nadherny | 412/41 |
| 3,107,375 | A | * | 10/1963 | Byland et al. | 412/41 |
| 3,180,488 | A | | 4/1965 | Heusmann | |
| 3,191,319 | A | | 6/1965 | Wasigerber | |
| 3,205,897 | A | | 9/1965 | Jamison | |
| 3,224,450 | A | | 12/1965 | Whittemore et al. | |
| 3,235,925 | A | | 2/1966 | Gerhardt | |
| 3,246,653 | A | | 4/1966 | Sexton | |
| 3,270,749 | A | | 9/1966 | O'Connell | |
| 3,276,450 | A | | 10/1966 | Pelezzare | |
| 3,280,240 | A | | 10/1966 | Bardy | |
| 3,362,411 | A | | 1/1968 | Moller | |
| 3,373,748 | A | | 3/1968 | Maccormack | |
| 3,433,688 | A | * | 3/1969 | Winkelmann et al. | 281/27.1 |
| 3,475,775 | A | | 11/1969 | Staats | |
| 3,483,067 | A | | 12/1969 | Staats | |
| 3,596,929 | A | | 8/1971 | Abildgaard et al. | |
| 3,706,503 | A | | 12/1972 | Foley | |
| RE28,202 | E | | 10/1974 | Abildgaard et al. | |
| 3,939,513 | A | * | 2/1976 | Crathern et al. | 412/6 |
| 3,950,107 | A | | 4/1976 | Seaborn | |
| 3,956,798 | A | * | 5/1976 | Wright | 281/27.1 |
| 3,970,331 | A | | 7/1976 | Giulie | |
| 4,031,585 | A | | 6/1977 | Adams | |
| 4,070,736 | A | | 1/1978 | Land | |
| 4,121,892 | A | | 10/1978 | Nes | |
| 4,135,832 | A | | 1/1979 | Saltz | |
| 4,200,404 | A | | 4/1980 | Agnew et al. | |
| 4,202,642 | A | | 5/1980 | Sjostedt | |
| 4,256,411 | A | | 3/1981 | Podosek | |
| 4,288,170 | A | | 9/1981 | Barber | |
| 4,302,123 | A | | 11/1981 | Dengler et al. | |
| 4,304,499 | A | | 12/1981 | Purcocks | |
| 4,305,675 | A | | 12/1981 | Jacinto | |
| 4,369,013 | A | | 1/1983 | Abildgaard et al. | |
| 4,398,856 | A | | 8/1983 | Archer et al. | |
| 4,429,901 | A | | 2/1984 | Clery, Jr. et al. | |
| 4,453,850 | A | | 6/1984 | Purcocks | |
| 4,453,851 | A | | 6/1984 | Purcocks | |
| 4,511,274 | A | | 4/1985 | Chen | |
| 4,525,117 | A | | 6/1985 | Jones | |
| 4,577,985 | A | | 3/1986 | Beyer | |
| 4,607,970 | A | | 8/1986 | Heusinkveld | |
| 4,620,724 | A | | 11/1986 | Abildgaard et al. | |
| 4,645,399 | A | | 2/1987 | Scharer | |
| 4,674,906 | A | | 6/1987 | Abildgaard et al. | |
| 4,685,700 | A | | 8/1987 | Abildgaard | |
| 4,693,624 | A | | 9/1987 | Moosmuller | |
| 4,708,560 | A | | 11/1987 | Abildgaard et al. | |
| 4,722,626 | A | | 2/1988 | Abildgaard | |
| 4,743,048 | A | | 5/1988 | Groswith, III | |
| 4,832,370 | A | | 5/1989 | Jones | |
| 4,873,858 | A | | 10/1989 | Jones | |
| 4,900,211 | A | | 2/1990 | Vercillo | |
| 4,904,103 | A | | 2/1990 | Im | |
| 4,934,890 | A | | 6/1990 | Flatt | |
| 4,997,208 | A | | 3/1991 | Staats, III | |
| 5,009,537 | A | | 4/1991 | Stengel | |
| 5,015,114 | A | | 5/1991 | Miller | |
| 5,028,159 | A | | 7/1991 | Amrich et al. | |
| 5,037,229 | A | | 8/1991 | Stengel | |
| 5,051,050 | A | | 9/1991 | Scharer | |
| 5,090,859 | A | | 2/1992 | Nanos et al. | |
| 5,102,167 | A | | 4/1992 | Groswith, III | |
| 5,123,675 | A | | 6/1992 | Staats, III | |
| 5,162,141 | A | | 11/1992 | Davey et al. | |
| 5,167,463 | A | | 12/1992 | Corbishley | |
| 5,370,489 | A | | 12/1994 | Bagrosky | |
| 5,383,756 | A | | 1/1995 | Coleman et al. | |
| 5,393,156 | A | | 2/1995 | Mullin et al. | |
| 5,464,312 | A | | 11/1995 | Hotkowski et al. | |
| 5,524,997 | A | | 6/1996 | von Rohrscheidt | |
| 5,584,633 | A | | 12/1996 | Scharer | |
| 5,653,544 | A | | 8/1997 | Cabre Pijoan et al. | |
| 5,669,747 | A | | 9/1997 | Scharer | |
| 5,782,569 | A | | 7/1998 | Mullin et al. | |
| 5,895,190 | A | * | 4/1999 | Viola | 412/40 |
| 6,000,894 | A | * | 12/1999 | Suzuki et al. | 412/11 |
| 6,168,337 | B1 | | 1/2001 | Adams | |
| 6,270,280 | B1 | | 8/2001 | Baumann | |
| 6,394,684 | B2 | | 5/2002 | Kapur et al. | |
| 6,435,753 | B1 | | 8/2002 | Gusack | |
| 6,450,492 | B1 | | 9/2002 | Coombs et al. | |
| 6,655,868 | B2 | | 12/2003 | Drew | |
| 6,669,392 | B2 | | 12/2003 | Rebora | |
| 6,955,493 | B2 | | 10/2005 | Acquaviva et al. | |
| 6,976,719 | B2 | | 12/2005 | Agayof et al. | |
| 7,198,422 | B2 | | 4/2007 | Ng et al. | |
| 2003/0147687 | A1 | | 8/2003 | Freund et al. | |
| 2004/0052615 | A1 | | 3/2004 | Fuchs et al. | |
| 2004/0240967 | A1 | | 12/2004 | Crudo et al. | |

FOREIGN PATENT DOCUMENTS

| | | |
|---|---|---|
| CH | 692912 | 12/2002 |
| DE | 1094708 | 12/1960 |
| DE | 1200252 | 9/1965 |
| DE | 1903490 | 7/1970 |
| DE | 8622425 | 10/1986 |
| DE | 29808713 | 9/1998 |
| EP | 0390199 | 10/1990 |
| EP | 0527246 | 2/1993 |
| EP | 0704322 | 4/1996 |
| EP | 0842790 | 5/1998 |
| EP | 1124694 | 1/2003 |
| FI | 31504 | 12/1960 |
| FR | 1060284 | 3/1954 |
| FR | 1228267 | 8/1960 |
| FR | 1364099 | 5/1964 |
| GB | 1569497 | 0/1908 |
| GB | 229515 | 2/1925 |
| GB | 755953 | 8/1956 |
| GB | 1225120 | 3/1971 |
| GB | 1372055 | 10/1974 |
| GB | 2193466 | 2/1988 |
| JP | 9240184 | 9/1997 |

* cited by examiner

APPARATUS AND METHODS FOR AUTOMATICALLY BINDING A STACK OF SHEETS WITH A NONSPIRAL BINDING ELEMENT

RELATED APPLICATIONS

This application claims priority to U.S. Provisional Patent Application Ser. No. 60/708,579 filed on Aug. 16, 2005 and U.S. Provisional Patent Application Ser. No. 60/709,710 filed on Aug. 18, 2005, both of which are incorporated herein by reference.

FIELD OF THE INVENTION

The present invention relates generally to binding elements for holding a plurality of perforated sheets or the like, and more specifically to automated processes and machines for handling and binding a plurality of successive perforated sheets into a book.

BACKGROUND OF THE INVENTION

Typically, mechanically bound books are created using either relatively small, inexpensive machines that require a significant amount of labor to create each book, or large, expensive machines that require much less labor per book. Use of small, inexpensive machines is widespread inasmuch as they are present in many offices. Such machines are adequate for creating relatively small quantities of books, provided the operator has received some training in their use and has sufficient time to devote to the effort of making the books. As the number of books to be assembled increases, however, the manpower required is significant when utilizing such small, inexpensive machines. In practice, it is not uncommon for operators to spend an hour or more assembling twenty to fifty books.

Automated machines, on the other hand, are relatively uncommon in offices. Rather, they are most often found in dedicated print shops or binderies. While these machines may be capable of creating the twenty to fifty books in as little as two to five minutes, the size and cost of automated machines can be prohibitive to smaller or occasional users. As a result, these more efficient, automated machines are typically available to only a very small percentage of people who desire mechanically bound books. Further, it is often time consuming for operators to set up such automated machines or to modify machines to change from one size or color of binding element to another. The specialized training required to operate and set-up automated binding machines further limits benefits available to general office users.

The preceding two decades have witnessed a dramatic change in the way documents are created and printed, however. The advent and adoption of personal computers and word processing software have greatly increased the user's options for production of documentation. Significant decreases in the cost of computers and printers, along with significant strides in efficiency and power have allowed nearly anyone the ability to design and print pamphlets, manuals, books, calendars and the like. As the ability to design and print documents has become widespread, the amount of time required to create a document has dropped dramatically. Unfortunately, however, for a majority of the people creating these documents, the ability to do mechanical binding has not improved significantly over the past two decades.

The ability to mechanically bind documents has not kept pace with the ability to create, edit and print the documents due in large part to fundamental problems with the currently available binding styles. Various types of binding elements have been utilized to mechanically bind a stack of perforated sheets or the like, including metal spiral wire or plastic spiral, double loop wire, wire comb, or hanger-type designs, plastic comb, hot-knife or cold-knife strip (marketed by the assignee of the present invention as VeloBind®), loose leaf binders, such as 3-ring binders, and other dedicated mechanical binding structures, such as the assignee's ProClick®. Examples of such binding elements which are of a wire comb or hanger-type design are disclosed, for example, in U.S. Pat. No. 2,112,389 to Trussell and U.S. Pat. Nos. 4,832,370 and 4,873,858 to Jones, while machines for assembling such binders are disclosed in U.S. Pat. No. 4,031,585 to Adams, U.S. Pat. No. 4,398,856 to Archer et al., U.S. Pat. No. 4,525,117 to Jones, U.S. Pat. No. 4,934,890 to Flatt, and U.S. Pat. No. 5,370,489 to Bagroky. Other binding devices are disclosed, for example, in the following references: U.S. Pat. Nos. 2,089,881 and 2,363,848 to Emmer, U.S. Pat. No. 2,435,848 to Schade, U.S. Pat. No. 2,466,451 to Liebman, U.S. Pat. No. 4,607,970 to Heusenkveld, U.S. Pat. No. 4,904,103 to Im, U.S. Pat. No. 5,028,159 to Ammich et al., U.S. Pat. No. 4,369,013, Reexamination Certificate B1 U.S. Pat. Nos. 4,369,013 and Re. 28,202 to Abildgaard et al. Machines for assembling plastic comb or finger binding elements are disclosed in patents such as U.S. Pat. No. 4,645,399 to Scharer, U.S. Pat. No. 4,900,211 to Vercillo, U.S. Pat. No. 5,090,859 to Nanos et al., and U.S. Pat. No. 5,464,312 to Hotkowski et al. Nail-type and VeloBind® elements are disclosed in patents such as U.S. Pat. No. 4,620,724 to Abildgaard et al., and U.S. Pat. Nos. 4,685,700, 4,674,906, and 4,722,626 to Abildgaard. All patents and publications referenced in this disclosure are included herein by reference.

Non-spiral binding elements typically include a spine from which a plurality of fingers extends that may be assembled through perforations in a stack of sheets. This spine may be linear, with or without a longitudinally extending hinge. Alternately, the spine may be formed by sequential bending of a wire, as with wire comb or hanger type binding elements. While each of these binding arrangements has its advantages, each suffers from various limitations particular to the type of binding.

Due to the structure of such binding devices, which typically include elongated spines and fingers, the binding devices commonly become entangled when stored in a group. Detangling the binding elements in order to assemble and individual element into a stack of sheets or lay the element into a binding machine can be a tedious and potentially time-consuming process. Further, this tendency to become entangled may complicate or prevent the use of such binding devices in automated binding processes or machines wherein an automated feed is desirable. The time required to manually feed binding elements into a machine would be prohibitive to efficient, high-volume automated binding operations. Moreover, maintaining an inventory of such binding elements in an automated machine can require a large volume of space within the machine, necessitating a relatively large footprint.

Due to the structure of such binding devices, which typically include predetermined length of fingers for a given binding element, the binding devices are commonly utilized to bind pre-selected thicknesses of stacks of sheets or, alternately, only a limited range of thicknesses of stacks of sheets. As a result, a user that may have the occasion to bind a larger range of stack thicknesses would be required to maintain an inventory of a range of sizes of binding elements. This inventory of various sizes of binding elements may be further multiplied when a user may bind a range of sizes of sheets themselves, i.e., when the stacks of sheets to be bound vary in length. This problem would be compounded in an automated binding process, requiring a large element storage space within the machine and/or frequent element changes within the machine to accommodate varied book sizes.

In order to accommodate varying thicknesses of stacks of sheets to be bound, various binding designs have been proposed. U.S. Pat. No. 2,779,987 to Jordan discloses a first strip from which two prongs extend, each of which is received in an opening in a retaining strip, wherein the retaining strip includes a ratcheting structure that secures the prong in position. More commonly used designs typically include a pair of bendable prongs extending from a first strip, which are inserted through openings in the stack of sheets and then into openings in a retaining strip. Each bendable prong is then bent over such that it is disposed substantially adjacent the axis of the retaining strip and then held in position by an interlocking structure or a locking flange or the like, which is slid over the bent end of the prong. Examples of binding structures of this type are disclosed in patents such as the following: U.S. Pat. No. 699,290 to Daniel; U.S. Pat. No. 2,328,416 to Blizard et al.; U.S. Pat. No. 3,224,450 to Whittemore et al.; U.S. Pat. No. 4,070,736 to Land; U.S. Pat. No. 4,121,892 to Nes; U.S. Pat. No. 4,202,645 to Sjöstedt; U.S. Pat. No. 4,288,170 to Barber; U.S. Pat. No. 4,302,123 to Dengler et al.; U.S. Pat. Nos. 4,304,499, 4,453,850, and 4,453,851 to Purcocks; U.S. Pat. No. 4,305,675 to Jacinto; and Great Britain Patent 1,225,120. In such designs, the user can typically reopen the resulting bound structure in order to remove or add further sheets.

A more complex design is disclosed in U.S. Pat. No. 3,970,331 to Giulie. The Giulie design is intended for use in libraries or other institutions for replacing the bindings on books or providing permanent bindings on magazines or the like. The binding structure is designed for assembly without the use of expensive machinery for clamping a book together, or the application of heat or mechanical pressure. The Giulie binding structure includes a pair of backing strips that are positioned along opposite sides of the stack of sheets adjacent preformed holes along one edge of the stack. One of the backing strips includes a plurality of studs having ratchet teeth, the other including a series of holes having a mating ratchet tooth. The studs ratchet through the holes, and a blocking means on the receiving strip is generally broken off of the strip and forced into the opening to permanently couple the studs within the openings. The studs may then be broken off or cut off. Thus, a book formed in this manner cannot be opened to edit the contents and then reengaged. Moreover, such a bound book cannot be readily folded back on itself, or lie open in a surface.

Such binding elements are not generally adaptable to highly automated binding machines. Automated binding machines require a supply of binding elements be located in or proximal to the device. The greater number of binding elements that can be loaded into a binding element magazine, the longer the machine can run without operator intervention. A smaller the overall size of the magazine, however, theoretically allows the machine to be designed with a smaller physical size.

While an element magazine of fifty to one hundred binding elements would seem ideal for general office use, the bulky nature of most currently available binding elements would generally make magazines required to accommodate such a large number of binding elements impractical. Loose-leaf binders, for example, are the poor from this standpoint inasmuch as the integral covers and ring assemblies take up considerable space. Although they can be nested one inside the other, a magazine of considerable length would be required to accommodate fifty to one hundred loose-leaf binders. Even if alternatingly stacked, this requires a considerable volume. For example, fifty binders capable of binding a one-half inch thick document would have a volume of 1700 cubic inches. Similarly, fifty plastic comb, metal spiral, double ring wire or plastic spiral binding elements would each require a volume on the order of 240 cubic inches, respectively, assuming that they are not allowed to mesh within each other and that they are provided to the machine already formed. ProClick® binding elements of the assignee of the present invention, assuming each element is provided to the machine in its open state, would require on the order of 320 cubic inches, while VeloBind®, likewise binding elements of the present assignee, would require on the order of 206 cubic inches. Each of these approximate volumes assumes that the elements are able rest in contact with each other in their most compact organization. Accordingly, these volume estimates do not include any provision for controlling orientation or assisting in delivery to the machine.

Packaging binding elements for automation presents significant additional challenges. The durability of the binding element itself may limit the methods by which binding elements are provided to an automated machine. Metal spiral and double loop wire, for example, are constructed of a thin metallic wire, which is relatively easy to deform, either before binding, which will make binding difficult or impossible, or after binding, which may impair page turning or damage the sheets themselves. Inasmuch as metal spiral and double loop wire binding elements are particularly susceptible to damage prior to binding, packaging of the binding element must protect the element for delivery to the binding machine.

Alternately, metal spiral and plastic coil elements are more efficient spatially when only the filament is provided to the binding machine and the binding machine itself creates the spiral or coil shape and binds the book. This method is utilized by many binderies in large, automated machines today. For fifty or one hundred elements, however, the space savings of this packaging are more than offset by the space required by the forming mechanism itself. Further, such coil formers introduce additional costs, as well as reliability and operator training issues.

When previously formed binding elements are utilized, not only must the element magazine contain a sufficient quantity of binding elements to minimize operator loading, it must support, align and present the binding elements in a form suitable for interaction with the binding machine. Thus, the binding elements must be presented such that the binding machine may remove an element from the magazine and position it in the binding mechanism for interaction with a stack of sheets and before finally finishing the book. The structure of virtually all loose binding elements, i.e. the elongated spine and fingers, makes them highly prone to tangling unless the elements are controlled by the magazine. Even plastic combs, which individually appear generally as a hollow tube with radial slots, sometimes become entangled when the spine of one element slips under the wrapped edge of another. As a result, if the packaging method does not control the elements, the binding machine must have sufficient mechanism to disentangle the elements. Such detangling mechanisms would presumably be prohibitively complex, as well as expensive and unreliable.

Large automated machines have attempted to control binding elements to eliminate or minimize tangling in various ways. For example, double loop wire is often formed as a continuous "rope" that is wound around a spool. To prevent entangling on the spool, a strip of paper or other separator material is wound jointly with the element to act as a barrier. This paper strip must be then unwound as the element is used and disposed of by the binding machine. Beyond the fact that the spools tend to be quite large (15-inch diameter spool that is 15 inches wide has a volume of 2650 cubic inches), this method adds cost to the element packaging, creates a waste product and adds an extra step during element changeover.

Plastic comb has been automated by attaching the binding elements to a continuous web of fanfold paper using an adhesive, as shown, for example, in U.S. Pat. No. 5,584,633. The machine drives the paper using a tractor feed system and separates individual elements from the paper as needed. In practice, this system can be problematic, however, inasmuch as the adhesive may be sensitive to time and environmental factors. If the adhesive does not adequately retain the elements, the elements will either disconnect from the paper completely, or twist or rotate on the paper, resulting in waste elements and/or causing jams within the binding machine.

Plastic coil elements have also been delivered to binding machines in compartmented cartridges that keep each element separated from the others, preventing entangling, as shown, for example, in U.S. Pat. No. 5,669,747. This system typically has the obvious disadvantages of high packaging cost and generally poor packing efficiency. The exception to this general rule has been VeloBind®, which is a two-part binding element structure with plastic male nails from one strip being received in female openings of another strip. VeloBind® has been efficiently packaged in cassettes of one hundred strips (e.g., U.S. Pat. Nos. 4,844,974, 5,051,050, and 5,383,756). While VeloBind® has proven to be a successful packaging and automation solution, a document bound with VeloBind® type elements cannot "lay flat", i.e., remain opened flat without the user holding the pages. This characteristic limits VeloBind's® potential with users seeking a pure "lay flat" bound book arrangement. Further, the VeloBind® element does not allow pages to cleanly "wrap around" behind the book after turning, a feature that allows the document to consume less space during use.

Dimensional stability of the binding elements themselves also significantly affects automated binding processes. Many mechanical binding styles have inherent manufacturing variations or material properties that make it difficult to automate them successfully. For example, double loop wire consists of a single wire filament formed into a comb pattern. The fingers of the comb are then bent toward the spine to create a "C" profile. The binding process then forces the fingers toward their opposing root on the spine, closing the element and creating a round "O" shape. Since the metallic wire has some inherent elastic properties, the tips of the fingers must be forced past the root some distance in order to ensure the element is closed after spring back. The amount of over-travel necessary to get a correct bind depends on the diameter of the wire, the diameter of the loop, the wire material properties and any work hardening induced on the metallic wire during forming of the "C" shape. Manufacturers of wire binding elements use different brands of wire filament and utilize slightly different profiles for the shape of the loops. Within a given manufacturer's double loop wire binding elements, standard manufacturing tolerances will also cause enough variation from box to box that the required over-travel is not necessarily consistent. These variations require a binding machine to have an adjustable closing stroke or stop position, not only for size changes, but also for each batch of wire elements. This may be acceptable if the machine is being set up for a long run or an operator is in constant attendance. Unfortunately, however, it is very difficult to create an easy to set up, easy to change, reliable binding machine in view of such variations.

Pitch is also a concern with regard to automation of binding processes to provide a bound book with a professional appearance. Pitch is a particular problem with double wire in that the spacing between successive finger loops is not necessarily constant. As the comb shape is formed from a single filament, there is no continuous feature, or spine, on the element that holds each finger in position relative to the next one. The binding machine must then constrain or guide the fingers in order to ensure that they properly line up with the perforations in the sheets to be bound. This is also a problem for metal spiral and plastic coil binding elements. As these elements are, in essence, springs with a low spring constant, the binding machine must control and guide the axial position of the leading point on the element as it is rotated through the document.

Plastic coils have an additional disadvantage caused by their material properties. A plastic coil element is generally an extruded vinyl filament that is heated to a softening temperature range and wound around a mandrel before being allowed to cool. This process tends to leave stresses in the binding element similar to that found in injection molded plastic pieces. If the element is subsequently exposed to elevated temperatures, these stresses will cause the element to "relax," changing the diameter, and, thus, the length of the element. Due to the low melt temperature of vinyl, these elevated temperatures can potentially be encountered during normal transportation, storage and usage. This is particularly problematic in the summer when the elements may be in a truck for several days during the transportation stage. These dimensional changes make feeding the element through the perforations more difficult and can impair the crimping process used to prevent the element from rotating out of the sheets after binding.

Thus, each of the binding elements currently known and available in the industry presents certain disadvantages, either in the packaging of the elements prior to binding, the automation of the binding process in connection with the elements, or in the qualities of a book bound by the elements. Even traditional loose-leaf binders are bulky and not readily, compactly packaged. They are cumbersome during use, and take up considerably more space than the documents they enclose. Further, even if the cover of a loose-leaf binder can wrap around behind the binder, the individual pages certainly cannot.

SUMMARY OF THE INVENTION

Accordingly, it is desirable to create binding elements and moderately priced, user-friendly, reliable mechanical binding machines that will be available other than exclusively to large volume binderies.

The invention provides an automated machine for processing a plurality of sheets into a bound book, including a plurality of inventive subassemblies. The machine receives a succession of single sheets from another processing machine, such as a printer or the like. If not yet punched, the machine punches an edge of each sheet before passing the sheets on to a stacker. If necessary, the machine reorients the sheets such that the edge to be punched becomes the leading edge. After punching, the sheet may be redirected so that the unpunched edge becomes the leading edge, depending upon the location of the binding module relative to the tray on which the perforated sheets are stacked. Such a reorientation mechanism is disclosed, for example, in International Application Serial No. PCT/US2006/030542 filed Aug. 4, 2006, and the priority applications thereto, which are hereby incorporated by reference for all matter disclosed therein.

Preferably, binding elements of a stack are held in relative positions without the need for a cartridge. Such binding elements are disclosed, for example, in International Application Serial No. PCT/US2005/024620 filed Jul. 12, 2005 and U.S. patent application Ser. No. 11/462,532 filed Aug. 4, 2006, and the priority applications thereto, which are hereby incorporated by reference for all matter disclosed therein. Such binding elements may include an elongated spine, a plurality of fingers extending from the spine, and adhesive on the spine configured to releasably attach the binding elements in the stack to one another and to attach the free ends of the respective fingers to the spine during the binding process.

A binding element is separated from the plurality of binding elements by an element feeder. One such appropriate structure for feeding elements includes a vacuum or suction member that initiates a separation of a portion of an element from the stack of elements. The binding element may then be further separated by structure such as a rotary separator and/or a sliding separator to separate the binding element from the stack. The element feeder may then direct the separated element into position for further conveyance, operation, or feeding. Preferably, the element feeder includes structure for retaining the stack of binding elements in a ready position for further feeding, including structure for retaining the last element or backing paper within the machine as the second to the last element or the last element, respectively, is separated.

The separated binding element may be further conveyed through the machine by an appropriate clamp, receiving member, or the like. If a flat or generally planar binding element is utilized, a bending and gusseting mechanism may be provided for establishing a bend and a gusset at an appropriate position on the binding element.

The fingers of the separated binding element are placed into respective perforations in the stack of perforated sheets. A binding mechanism, or a loop, size, and seal mechanism, then loops the free ends of the fingers around and engages the free ends of the fingers and the spine, such that the adhesive secures the free ends of the fingers to the spine. The bound book is then dropped to an output tray.

The design of the binding elements allows the automated binding machine to bind a range of thicknesses of stacks of perforated sheets and provide bound books having a professional appearance with an appropriately-sized binding element. Accordingly, the automated binding machine does not require a large inventory of various sizes of binding elements. Moreover, the automated binding machine requires minimal intervention by a user to bind books, regardless of the size of the stack of perforated sheets. The automated binding machine occupies a relatively small footprint such that it may be utilized in an office atmosphere in conjunction with other processing machines, such as a printer or copier. Should the user not wish to bind a plurality of sheets exiting the processing machine, the automated binding machine may include a bypass path simply to pass the sheets to an output tray or other processing machine.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION

Figure 1:
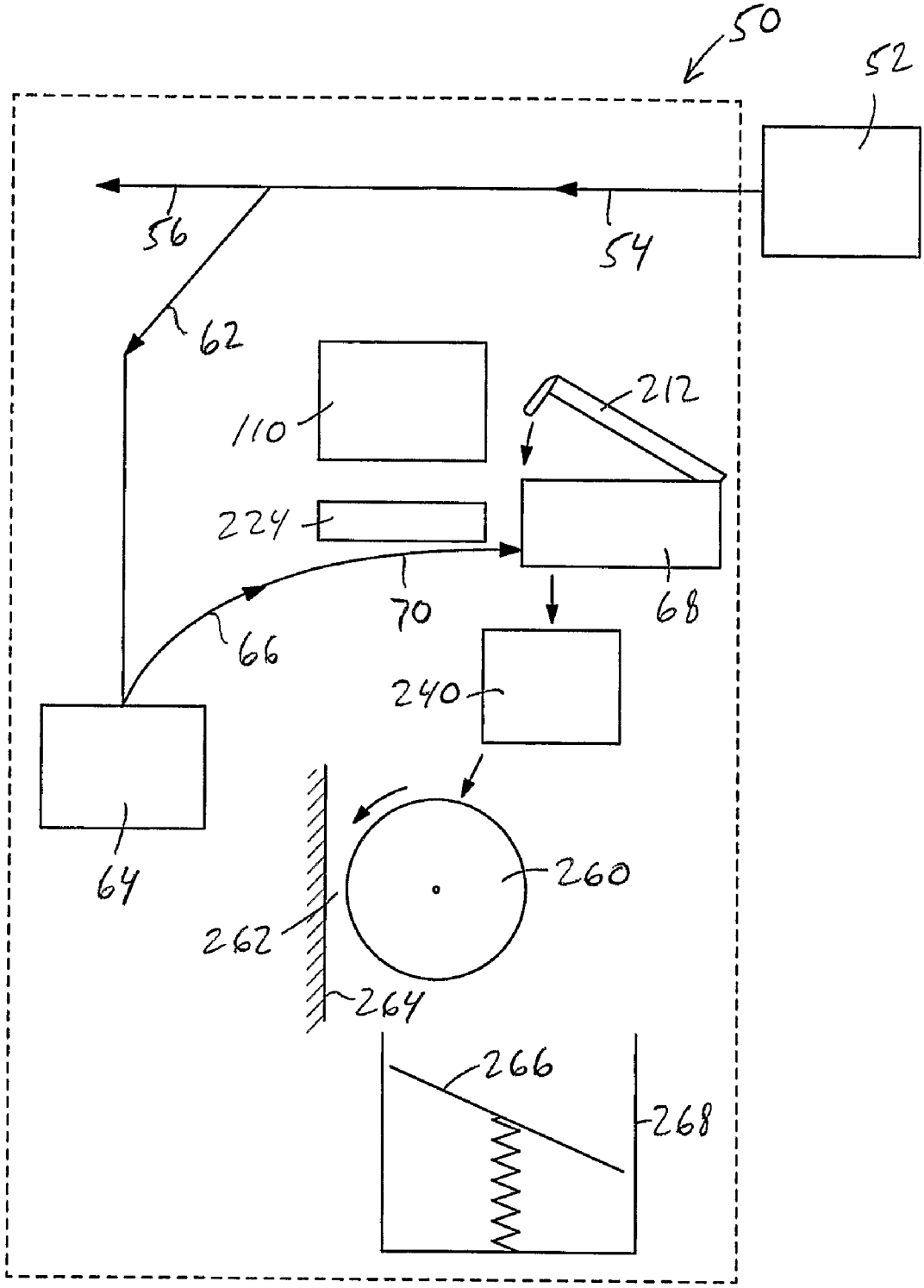
FIG. 1 is a schematic view of an automated binding machine of the present invention.

With reference to FIG. 1, a schematic view of an automated processing and binding machine 50 is shown. The processing and binding machine 50 may be coupled to a processing machine 52, such as a printer, copier, or the like, to receive a plurality of successive sheets directly therefrom for processing into a book.

The machine 50 may optionally punch and then bind a series of successive sheets to produce a book with no or minimal operator involvement. To allow the machine 50 to be utilized in a sheet processing system such that the binding operation may be performed on a plurality of sheets or the processes of the machine 50 may be bypassed, a sheet exiting the processing machine 52 along the entry path 54 to the machine 50 may bypass the operations of the machine 50 entirely by proceeding along the exit path 56. Alternately, the sheet may proceed for further processing by the machine 50 along path 62.

To prepare the sheets for further binding within the machine 50, the machine includes a punch 64. A suitable punch 64 is disclosed in greater detail in International Application Serial No. PCT/US2006/030542 filed Aug. 4, 2006, which is incorporated herein in its entirety for everything disclosed therein. The now leading edge of the sheet received at the punch 64 is perforated by the punch 64 and then redirected to path 66 for further processing. As explained in greater detail in International Application Serial No. PCT/US2006/030542, this punch and redirect arrangement allows the punching of consecutive sheets at a very high rate of speed such that the punching operation itself does not slow the flow of sheets through the machine 50. Moreover, it does not require the rapid accelerations and decelerations typically associated with incheck for end-of-line hyphenline punching arrangements. In the embodiment illustrated herein, the unperforated edge becomes the leading edge as the sheets exit the punch 64. When utilizing pre-punched sheets, the movement of the die within the punch 64 in the illustrated embodiment may be deactivated, such that the punch 64 is utilized merely to redirect the pre-punched sheets to path 66 such that they are properly presented for the next operation.

Alternate punching arrangements may be provided, however. If an in-line or rotary punching arrangement is provided, such as the arrangements disclosed in published U.S. Patent Application Nos. 2005-0081694 A1 or 2005-0039585 A1, which allow the sheet to pass through the punch after or with the punching operation, the perforated edge would lead as the sheet exits the punch. As a result, a redirection module (not shown) would be disposed following the punch such that the unperforated edge of the sheet would proceed along path 66 in the arrangement shown in FIG. 1. It should thus be appreciated by those of skill in the art that any combination of punches and/or redirection modules, or neither a punch or redirection module need be provided, so long as the sheets or a stack of sheets are properly presented for binding.

With continued reference to FIG. 1, to prepare the punched or pre-punched sheets for placement of a binding element, the successive sheets are advanced to a stacker 68. The sheets proceed along a stacker entry path 70 through feeder 71 by any appropriate method, including, but not limited to one or more driven in-feed rollers 73, belts, or other arrangement, to be stacked on a support member or a tray 72 (see FIG. 2*a*). A nip 76 may further be provided along the stacker entry path 70 to provide a desired level of force, or a desired velocity to the sheets as they transition from the stacker entry path 70 to the tray 72. In the illustrated construction, the nip 76 is formed by one or more pairs of rollers 80, with the lower roller 80*a* being driven. With continued reference to FIG. 2*a*, one or more static brushes 75 may be coupled to the stacker 68 to eliminate static charge in the sheet prior to the stacking/accumulating of the sheets in the tray 72. Further, one or more static brushes 75 may be coupled to other portions of the automated binding machine 50, such as the pivoting clamp 212, which is described in more detail below.

Figure 2A:
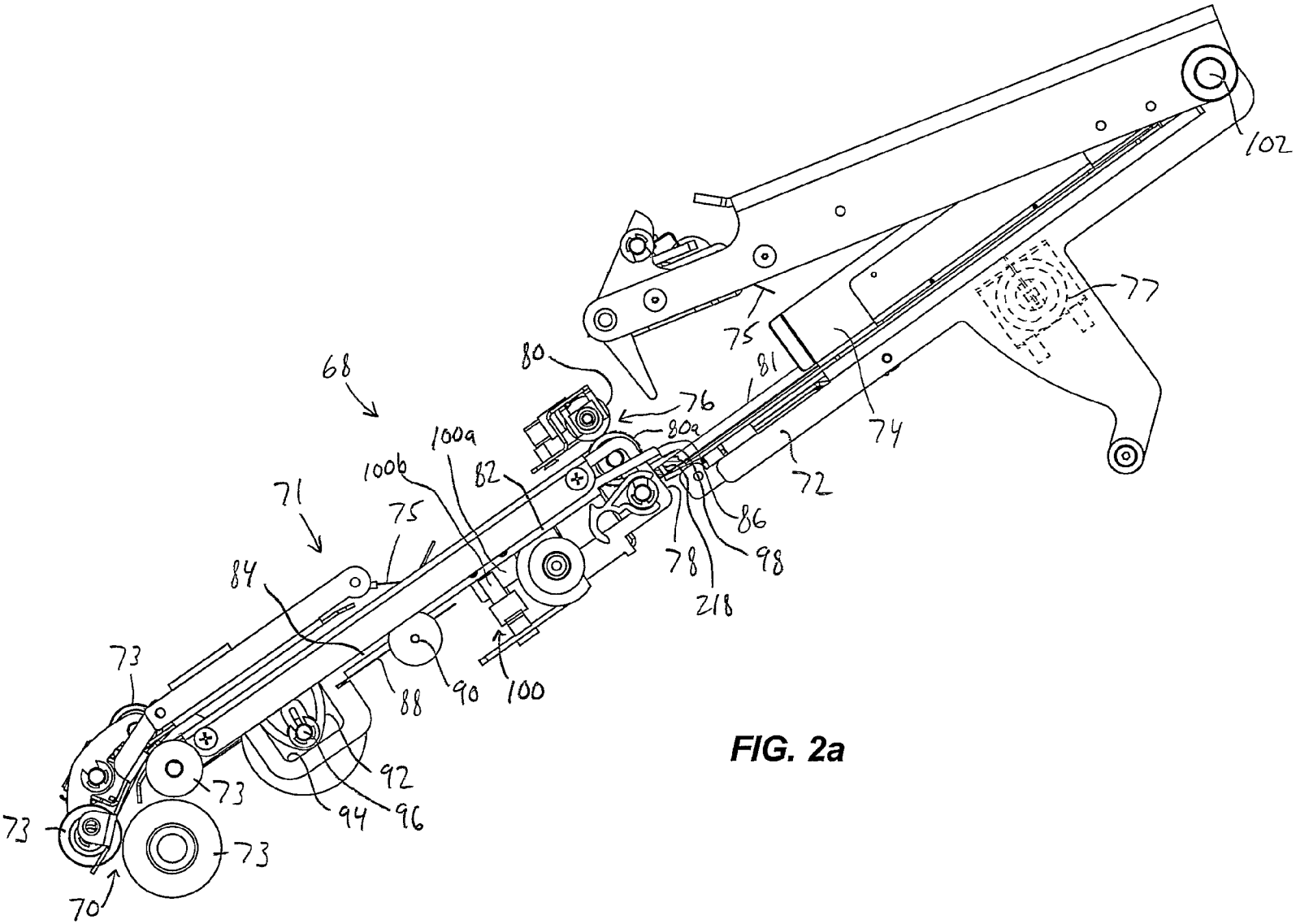
FIG. 2*a* is a fragmentary side view of a stacker of FIG. 1 constructed in accordance with teachings of the invention, and a receiving member coupled to the stacker.

With reference to FIG. 2*a*, the tray 72 may include side flanges 74 to urge the sheets to a central or desired position on the tray 72. One or more solenoids 77 may be coupled to the side flanges 74 to move the side flanges 74 away or toward each other to facilitate the alignment of the successive sheets as they are stacked on the tray 72 (see also FIG. 9).

With reference to FIG. 2*a*, a flange 78, positioned on either the feeder 71 or the tray 72, may extend generally normal to the tray 72 for abutting the edge of the stack of perforated sheets to be bound. In the construction of the stacker 68 illustrated in FIG. 2*a*, the flange 78 is positioned on the feeder 71.

Figure 3:
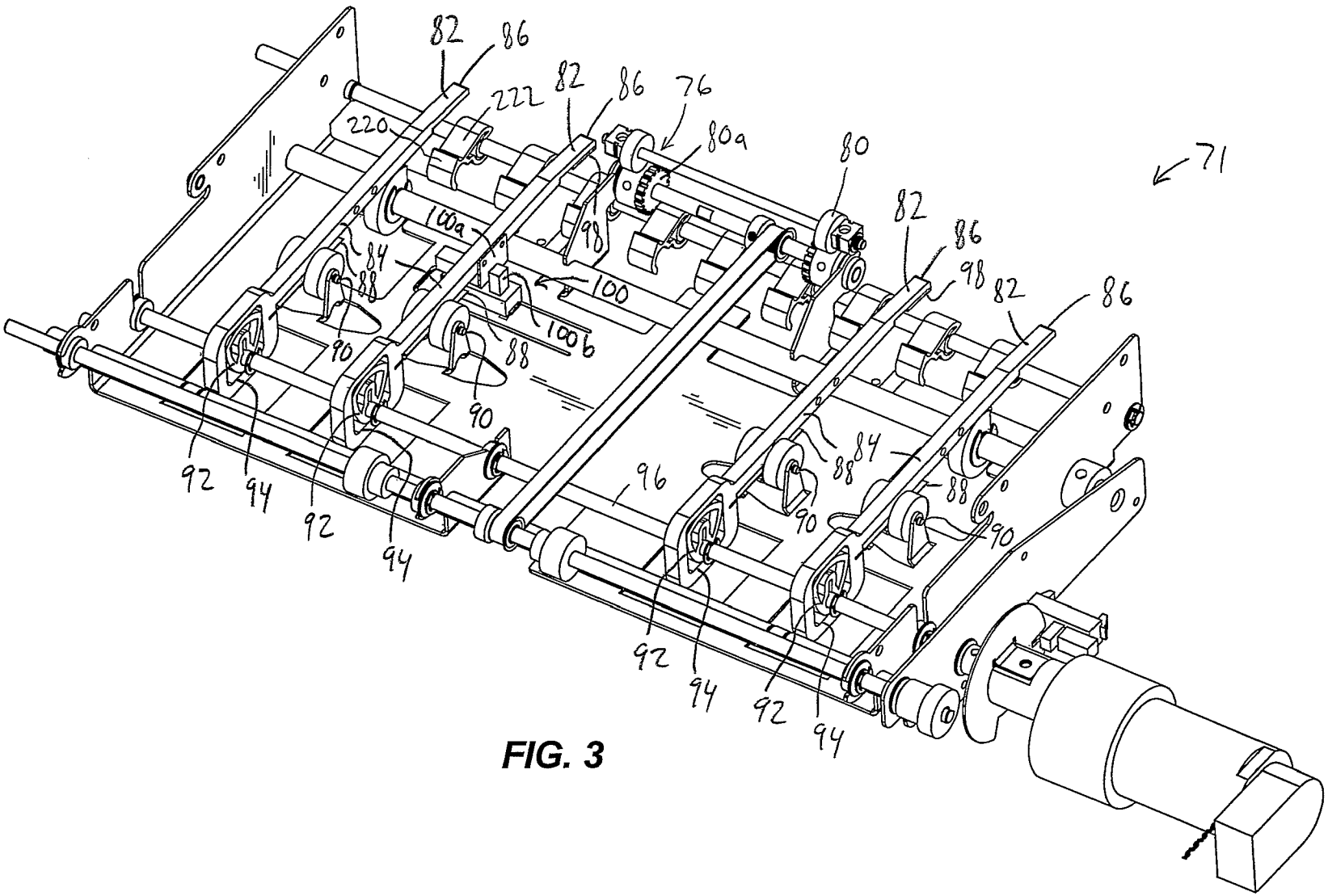
FIG. 3 a fragmentary top perspective view of the stacker of FIG. 2*a*, illustrating multiple fingers driven by respective cams.

In order to urge the proper placement of the sheets on the tray 72, the stacker 68 may further be provided with a placement element that exerts a downward force on the uppermost sheet of a stack 81 to minimize float and minimize the possibility for entanglement or tie-up with a following sheet that is placed on the stack. The placement element further preferably exerts a pulling force to ensure registration of the sheet against the flange 78. In the embodiment illustrated, the placement element comprises a plurality of fingers 82 spaced along the length of the sheet, as shown in FIG. 3. While the placement element illustrated comprises a plurality of such fingers 82, it will be appreciated that the placement element could alternately comprise a single structure, so long as the desired placement force is exerted on the individual sheets progressing into the tray 72.

Figure 4A:
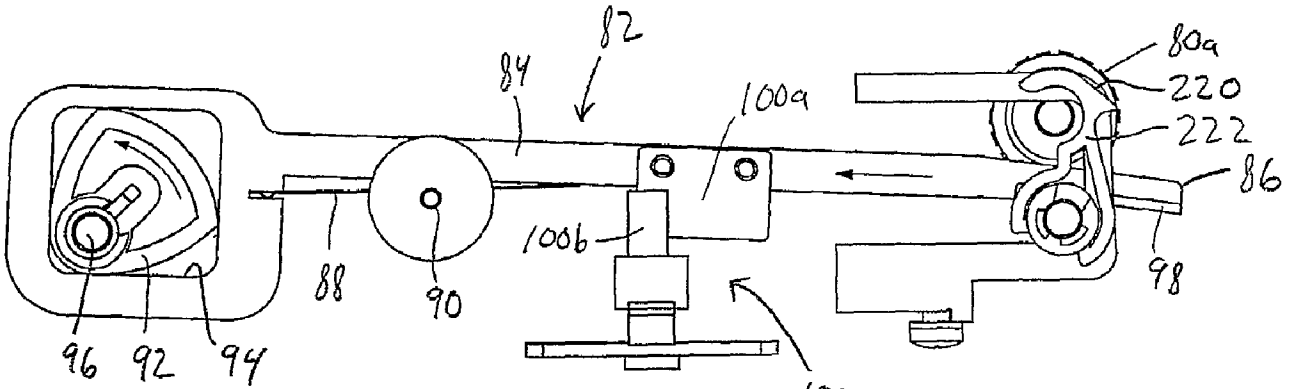
FIGS. 4*a*-4*d* are enlarged fragmentary side views of one of the fingers of the stacker of FIGS. 2*a* and 3 in four different positions according to the rotational position of the cam driving the finger.
Figure 4B:
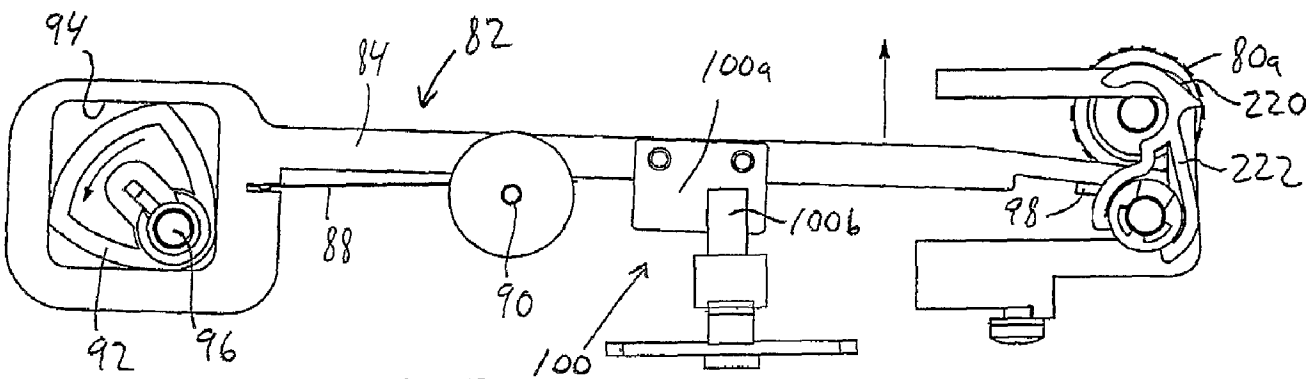
Figure 4C:
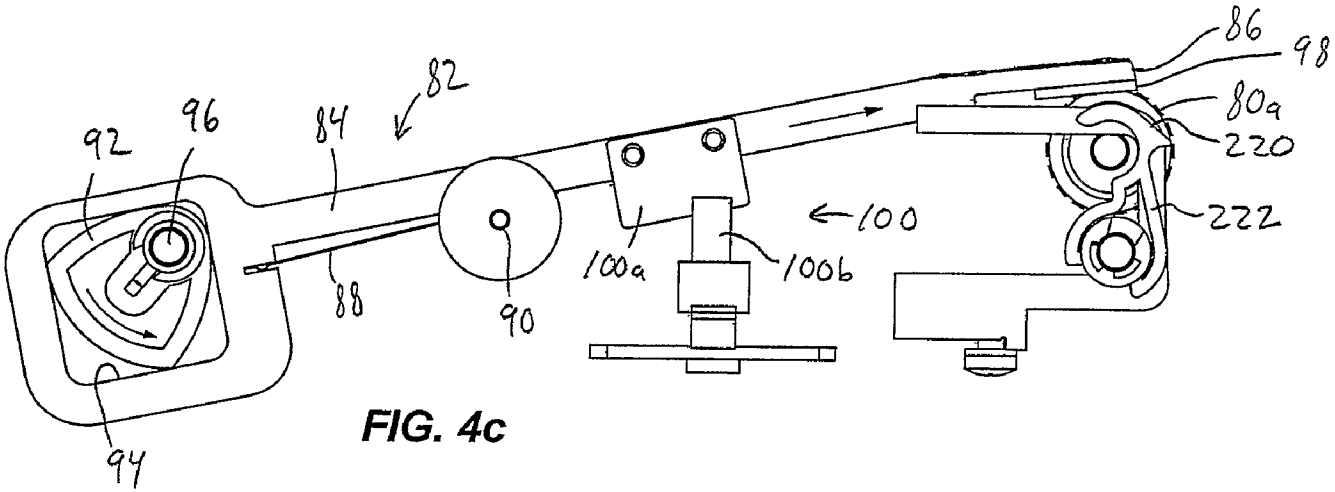
Figure 4D:
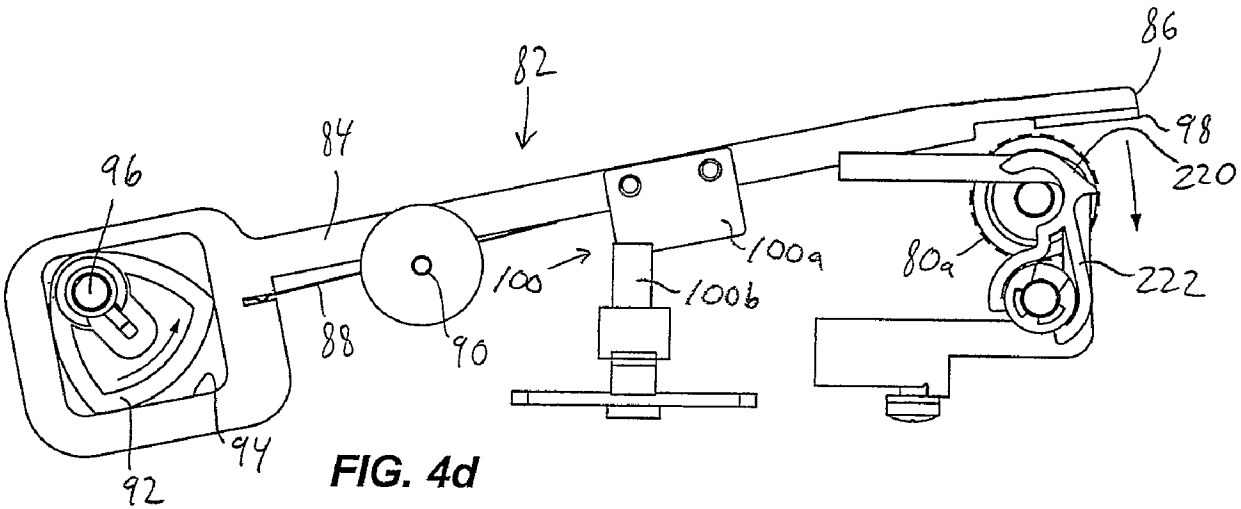

With reference to FIGS. 3-4*d*, the illustrated fingers 82 include an elongated body 84 with an engagement tip 86 and a lower spring element 88. Movement of the fingers 82 is governed by a pin 90 disposed between the body 84 and the spring element 88, and a driven camming arrangement including a driven cam 92 disposed within a window 94 formed at the end of the body 84 opposite the tip 86. As a shaft 96 extending through the cams 92 is rotated, the fingers 82 slide along and pivot about the pin 90 disposed between the elongated body 84 and the lower spring element 88.

FIGS. 4*a*-4*d* illustrate one of the fingers 82 in each of the four relevant positions of the finger 82 as the cam 92 rotates. More specifically, as a sheet advances along the stacker entry path 70 into the tray 72, the sheet flows over the lowered finger (see FIG. 4*a*) in position on the top of the stack 81 held in the tray 72, thus preventing a binding of the newly entering sheet on the sheets already held in the tray 72. As the sheet enters the tray 72, the finger 82 pulls back on the sheet presently held on the top of the stack 81, sliding along the pin 90, i.e., the finger 82 recesses to the position shown in FIG. 4*b* as the cam 92 rotates to a forward, upper position (see FIG. 4*b*). The finger 82 then pivots upward about pin 90 to the position shown in FIG. 4*c* as the cam 92 continues to rotate to a forward, lowermost position (see FIG. 4*c*). As the cam 92 continues to rotate to a rearward, lowermost position, the finger 82 is again pushed forward toward to the tray 72 to the position shown in FIG. 4*d* as the finger 82 slides along the pin 90 (see FIG. 4*d*). In this way, the tip 86 of the finger 82 is projected above the sheet newly deposited on the stack 81 of sheets supported on the tray 72. As the cam 92 continues to rotate to the rearward, uppermost position, the finger 82 pivots about the pin 90 and again moves to a lowered, projected position shown in FIG. 4*a*, pressing the newly deposited top sheet into the supported stack 81 of sheets (see again FIG. 4*a*). As the next sheet moves into position on the top of the stack 81, the finger 82 pulls back on the top sheet of the stack 81, urging it to the flange 78, as the finger movement repeats itself.

With reference to FIGS. 3-4*d*, the elongated body 84 of each finger 82 is preferably formed of a relatively rigid material while the lower spring element 88 is formed of a rigid, yet resilient material. In the illustrated construction of the fingers 82, the body 84 is made from a polymeric material, such as Delrin® available from E.I. du Pont de Nemours and Company, while the spring element 88 is made from a resilient metal (e.g., spring steel) and coupled to the body 84. Alternatively, the fingers 82 may be unitarily formed of a polymeric material, such as Delrin®, although it may be formed of one or more alternative materials, unitarily, or as separate components.

With reference to FIGS. 3-4*d*, one or more of the fingers 82 may further include a friction element 98 to provide increased friction between the fingertip 86 and the sheet disposed along the top of the supported stack of sheets. The friction element 98 may be formed of any appropriate material, such as, for example, polyisoprene, or other rubber, polymer, or foam. In one embodiment, four fingers 82 are provided, two of which include a friction element 98. The remaining fingers 82 do not include a friction element 98. Accordingly, the fingers 82 that do not include a friction element 98 do not exert as high of a pulling force on the top sheet, but, rather, act to provide a generally uniform downward force to the stack of sheets to ensure proper positioning of the following sheet to the top of the stack. In other embodiments fewer or more fingers 82 can be used, with any combination including friction elements 98.

In one embodiment, additional devices or elements can be coupled with the stacker 68 to further facilitate proper stacking of the sheets. In one example, a plate can be linked with movement of one or more of the fingers 82 to engage the top sheet over a substantial portion of the surface area. Such a plate can act to tamp or compress the stack 81 to help eliminate air between the sheets.

With reference to FIG. 2*a*, the tray 72 pivots about pivot 102 to pivot the tray 72 to a relatively lower position as the size of the stack increases. In order to accommodate varied sizes of supported stacks 81 of sheets, the stacker 68 may further include a sensor 100 or the like to sense automatically the height or the thickness of the stack 81 supported on the tray 72. With reference to FIG. 3, the sensor 100 includes a flag 100*a* disposed along the finger 82 and a sensing beam 100*b*. When the finger 82 is in contact with the tray 72 itself, the flag 100*a* blocks the path of the sensing beam 100*b*. In operation, as the stack 81 of sheets on the tray 72 becomes thicker, the flag 100*a* eventually no longer blocks the sensing beam 100*b*. Thus, when the stack 81 on the tray 72 reaches this predetermined height or thickness, such that the flag 100*a* no longer blocks the path of the sensing beam 100*b*, the tray 72 may be automatically lowered by any appropriate mechanism. As the tray 72 is lowered, the position of the finger 82 returns generally to a position wherein the flag 100*a* again blocks the path of the sensing beam 100*b*. Similarly, after further movement of the tray 72 during operation of the machine 50, the sensor 100 identifies and governs the "home" or starting position of the tray 72 such that the tray 72 returns to the "home" position to allow the start of another stacking operation. Additionally, the sensed height or thickness of the supported stack 81 may be utilized in other aspects of the binding process or other machine operation, for example, during the binding element closing operations as will be discussed below.

Figure 2B:
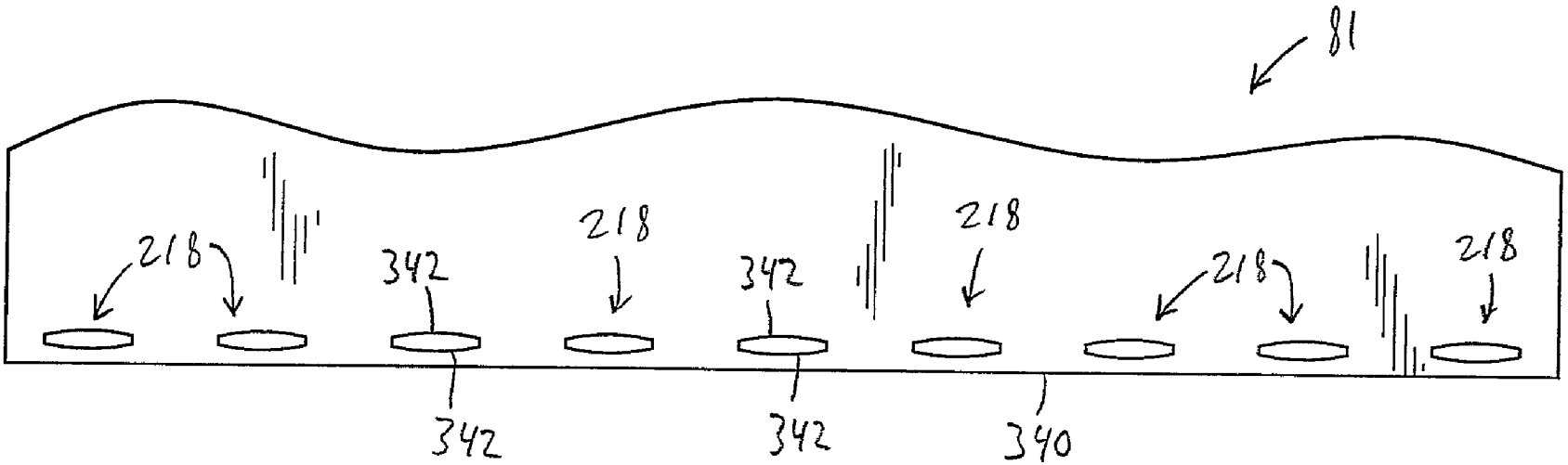
FIG. 2*b* is a top view of a stack of perforated sheets configured to be supported in the stacker of FIG. 2*a*.
Figure 2C:
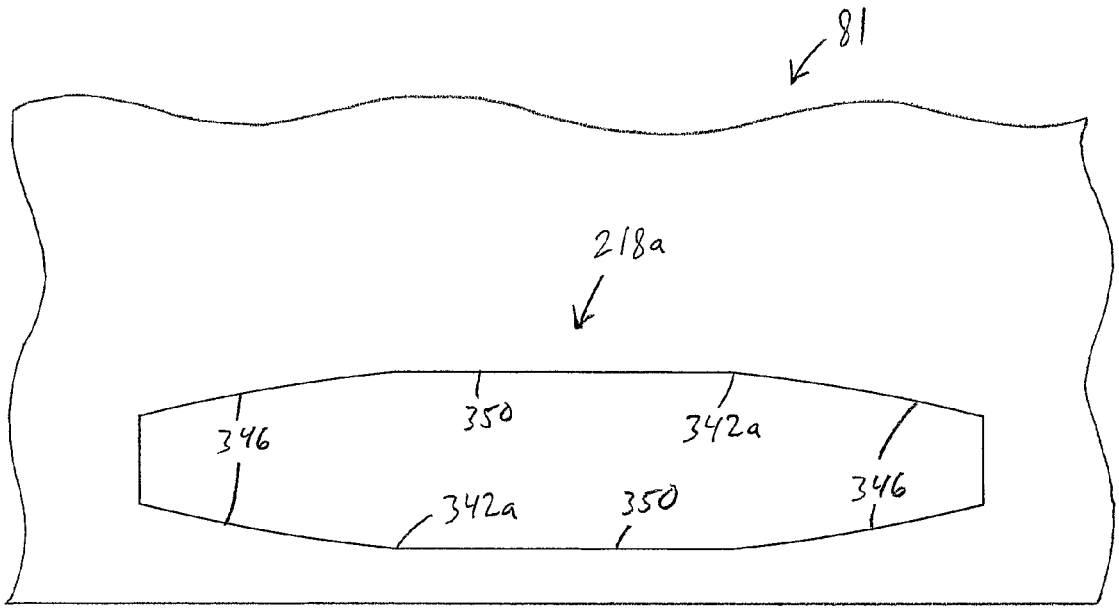
FIG. 2*c* is a partial top view of a stack of perforated sheets, having an alternative configuration of perforations, configured to be supported in the stacker of FIG. 2*a*.

With reference to FIG. 2*b*, a stack 81 of sheets configured to be supported in the tray 72 is shown. A plurality of holes or perforations 218 are punched along respective edges 340 in the individual sheets in the stack 81, and the perforations 218 in adjacent sheets in the stack 81 are aligned as a result of the operation of the stacker 68 as described above. To facilitate stacking of the perforated sheets and alignment of the perforations 218 in the individual sheets in the stack 81, the perforations 218 may each include at least partially arcuate longitudinal edges 342 opposite one another generally forming what can be referred to as a "double-D" shaped perforation 218. As shown in FIG. 2*b*, substantially the entire length of the longitudinal edges 342 is arcuate. FIG. 2*c* illustrates an alternative construction of the double-D shaped perforation 218*a*, including longitudinal edges 342*a* having both arcuate portions 346 and substantially straight portions 350. As illustrated in FIG. 2*c*, the substantially straight portions 350 are located intermediate the arcuate portions 346 on each of the longitudinal edges 342*a*. As a result of the double-D shape of the perforations 218, 218*a*, individual sheets, as they are being stacked and aligned, are less likely to become caught or hung up in the perforations 218, 218*a* of an underlying sheet.

Figure 5:
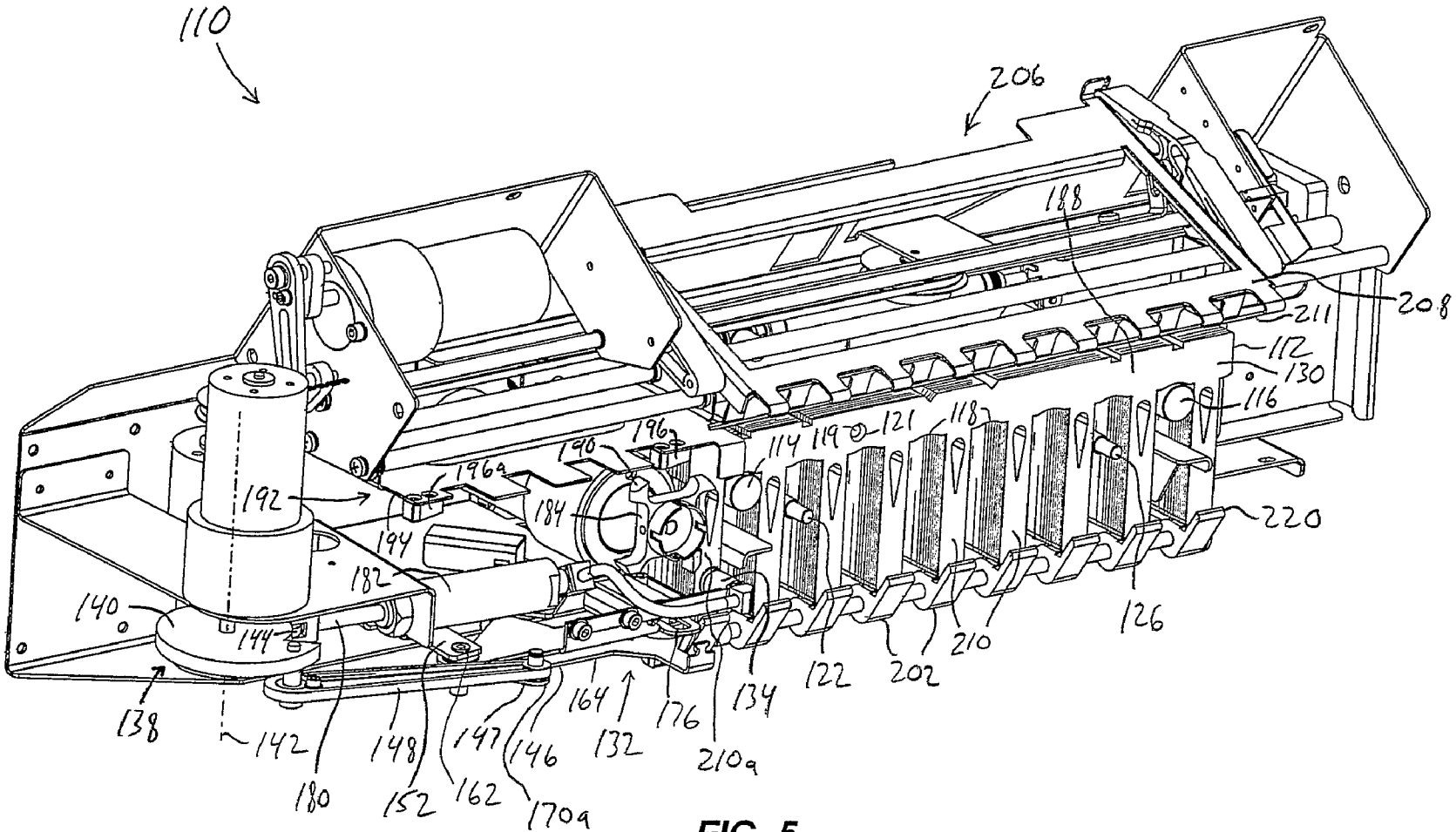
FIG. 5 is a fragmentary front perspective view of a binding element feeder of FIG. 1 constructed in accordance with teachings of the invention, illustrating a stack of binding elements, a suction member, a rotary separator, and a sliding separator configured to separate individual binding elements from the stack of binding elements.
Figure 6:
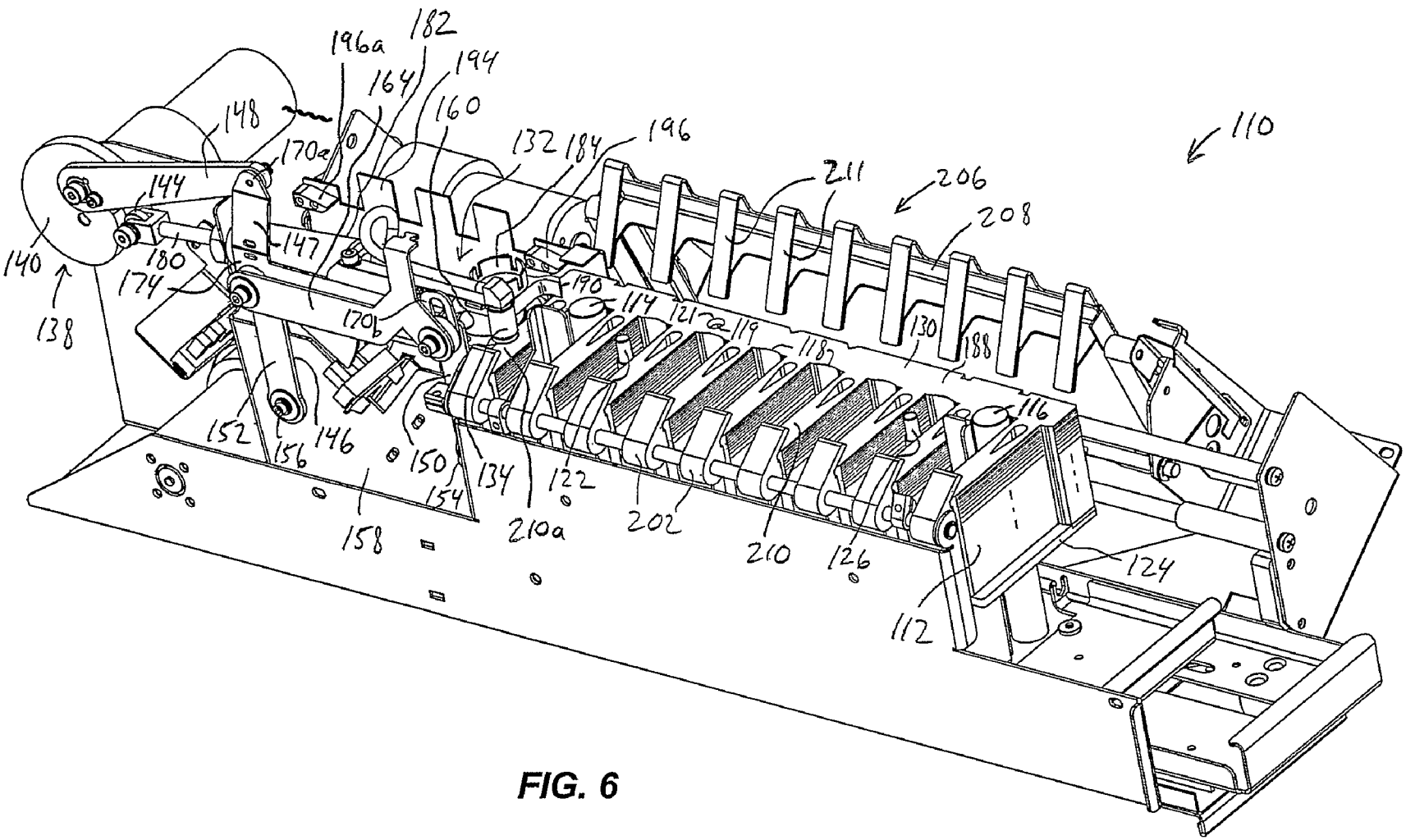
FIG. 6 is a fragmentary bottom perspective view of the binding element feeder of FIG. 5.

With reference to FIGS. 5 and 6, once the stack 81 of sheets is complete on the tray 72, a binding element feeder 110 may insert a binding element 112 into the appropriately aligned perforations 218 in the stack 81 of sheets. It should be appreciated by those of skill in the art that provisions may be made in the machine 50 for manual placement of a pre-punched and aligned stack of sheets by of any appropriate mechanism such as, by way of example only, the tray 72 being supported by a drawer slide.

Turning now to the binding element feeder 110, which is shown generally in FIG. 1, and in a more detailed, fragmentary view in FIGS. 5 and 6, the binding element feeder 110 provides for uninterrupted binding of stacks of perforated sheets or books without intervention by an operator. Accordingly, the feeder 110 includes a supported supply of binding elements 112. The illustrated binding elements 112 are disclosed in greater detail in published PCT Patent Application No. WO02006017255 and U.S. patent application Ser. No. 11/462,532 referenced above. In short, the binding elements 112 each include a spine 188 from which a plurality of fingers 210 extend. As described in more detail below, the fingers 210 are the portions of the binding element 112 that are inserted through perforations 218 in the stack 81 of separated sheets, while the spine 188 is the portion of the binding element 112 that is not inserted into the perforations 218.

The spine 188, the fingers 210, or both include one or more areas or spots of adhesive 186 for subsequently coupling the distal ends or tips 204 of the fingers 210 to the spine 188 (see FIG. 14*b*) to form respective loops that are used to bind a stack 81 of perforated sheets. The binding elements 112 are of a relatively thin structure such that they may be disposed adjacent (e.g., where generally planar binding elements 112 are used) or nest with one another (e.g., where generally pre-bent or L-shaped binding elements 112*a* are used, see FIG. 14*c*) such that the adhesive 186 is also utilized to releasably couple or interconnect the plurality of binding elements 112 together to form a cohesive group, plurality, or a stack that does not require an external cartridge or coupling structure to maintain the relative positions of the elements 112 with respect to one another. Alternatively, the distal ends or the tips 204 of the fingers 210 may be attached to the spine 188 using other methods besides re-using the adhesive 186. For example, rather than providing the adhesive 186 to attach the fingers 210 to the spine 188 of the binding element 112, a welding process (e.g., ultrasonic welding, RF-welding, friction welding, and so forth) may be utilized to secure the tips 204 of the fingers 210 to the spine 188 (see weld zone 354 in FIG. 14*d*). Alternatively, a mechanical fastener 358 (e.g., a rivet) may be utilized to secure the tips 204 of the fingers 210 to the spine 188 (see FIG. 14*e*). As yet another alternative, the tips 204 of the fingers 210 may be deformably coupled to the spine 188 (see FIG. 14*f*). In other words, after the tips 204 of the fingers 210 and the spine 188 are brought into contact, a male and female die set may be utilized to permanently deform portions of the fingers 210 and portions of the spine 188, resulting in a plurality of indentations 362 that secure the tips 204 of the respective fingers 210 to the spine 188.

Inasmuch as the binding elements 112 do not require a cartridge or bulky coupling structure from which the binding elements 112 must be separated, there is virtually no waste from the binding elements 112 within the machine 50, and no provision or space is required within the machine 50 for collection of waste for later disposal or recycling. Rather, the stack of binding elements 112 may be loaded directly in the feeder 110 as a single unit. Depending upon the structure of the element stack indexer (as will be discussed below), any release paper disposed along the adhesive of the lowermost element 112 may be removed prior to placement of the stack of elements 112 into the machine 50. To facilitate loading, the binding element feeder 110 or a portion thereof may be disposed on drawer slides or the like, or may be otherwise accessible to allow placement of the supply of binding elements 112 into the machine 50. Although the particular design of binding element may vary from the illustrated design, the illustrated binding element design provides a large inventory of binding elements 112 in a relatively small volume. For example, rather than providing flat or generally planar binding elements 112 to the binding element feeder 110, pre-bent or L-shaped binding elements may be used.

As shown in FIG. 5, the stack of binding elements 112 is supported within the feeder 110 on one or more supports 114, 116. It should be noted that the stack of binding elements 112 may include one or more scallops 118, channels, bores, or the like for mating receipt of the supports 114, 116 to ensure proper placement of the stack of binding elements 112 within the binding element feeder 110. The binding element feeder 110 may further include structure for advancing the stack of binding elements 112 along the supports 114, 116 to place the stack of binding elements 112 in position to present a single binding element 112 for binding into the stack 81 of perforated sheets. In the illustrated embodiment, the structure for advancing the stack of binding elements 112 includes a plurality of rods 122, 126 along which a back plate 124 may ride to advance the stack of binding elements 112 forward, although it should be appreciated that the support structure and advancing structure may be of any appropriate design.

Figure 14A:
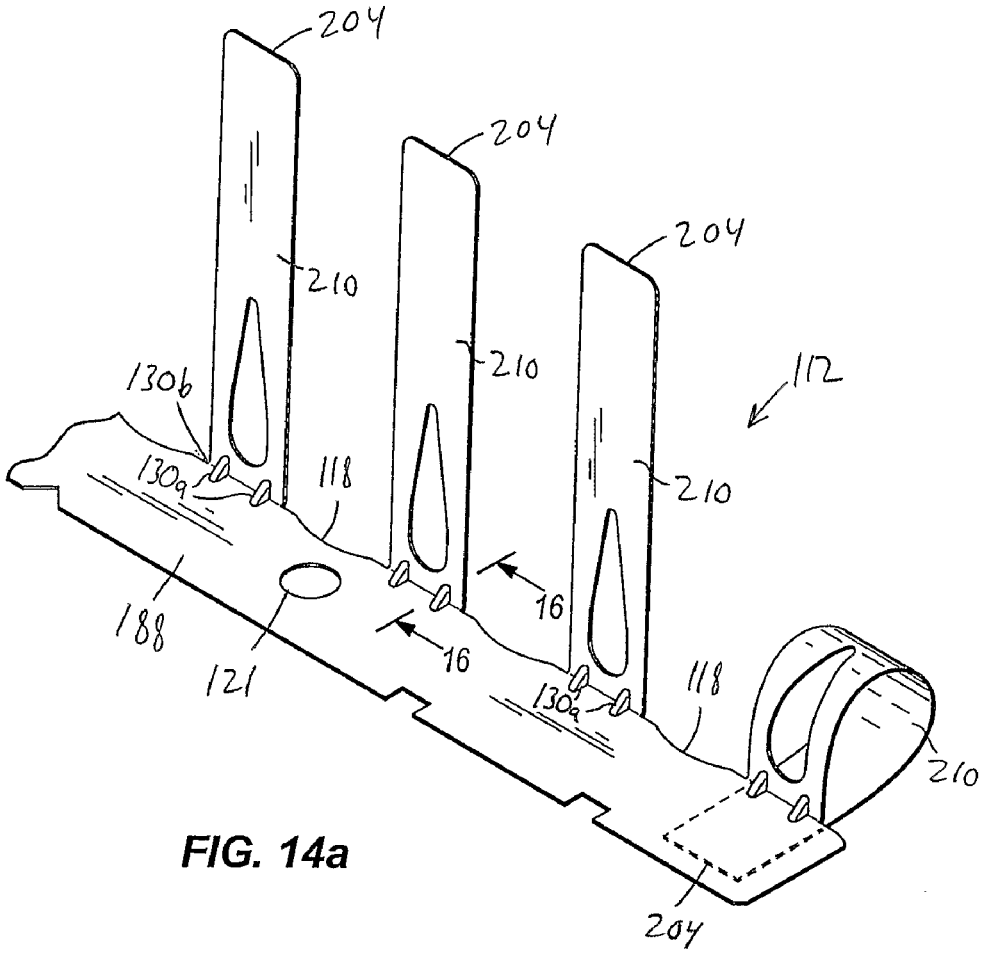
FIG. 14*a* is a top perspective view of a portion of an individual binding element from the stack of binding elements of FIG. 5, illustrating multiple bends and gussets formed in the individual binding element by the bending and gusseting mechanism, and illustrating a free end of a finger of the binding element looped around and secured to a spine of the binding element via adhesive.
Figure 14B:
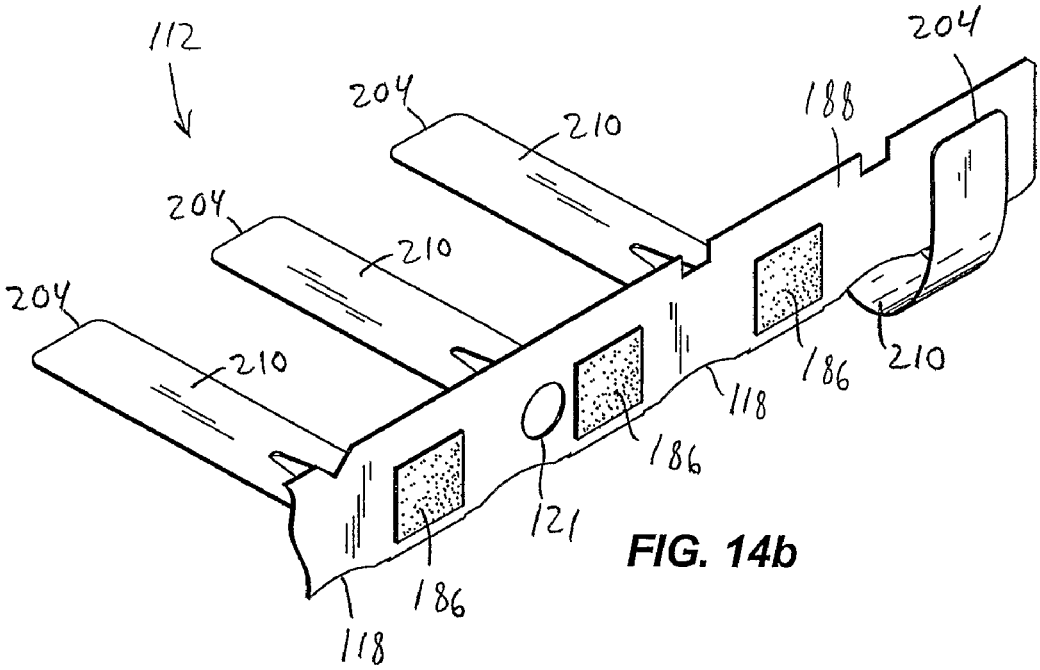
FIG. 14*b* is a bottom perspective view of the binding element of FIG. 14*a*, illustrating the adhesive configured to secure the free ends of the respective fingers to the spine of the binding element.
Figure 14C:
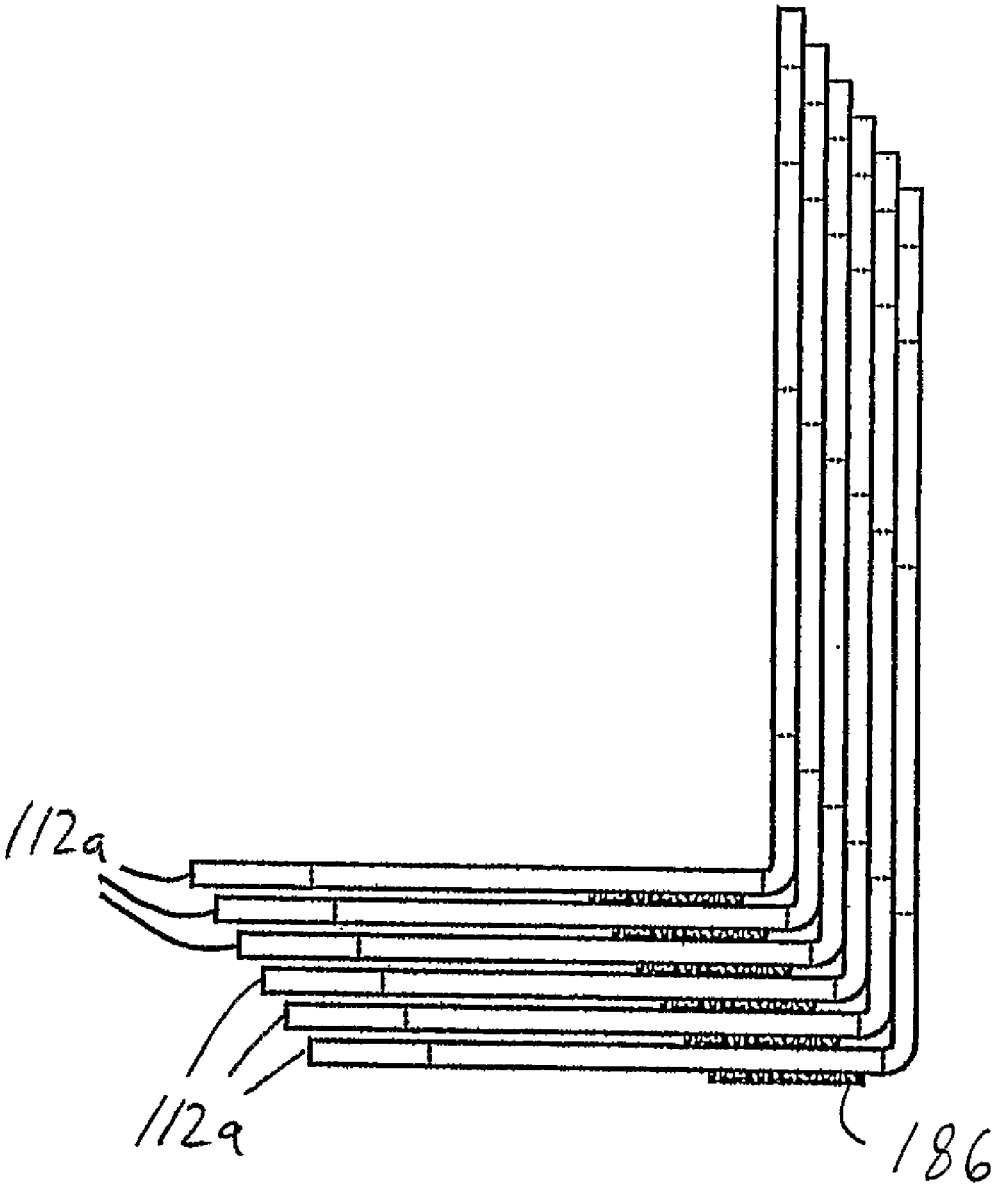
FIG. 14*c* is a side view of a stack of pre-bent or generally L-shaped binding elements.
Figure 14D:
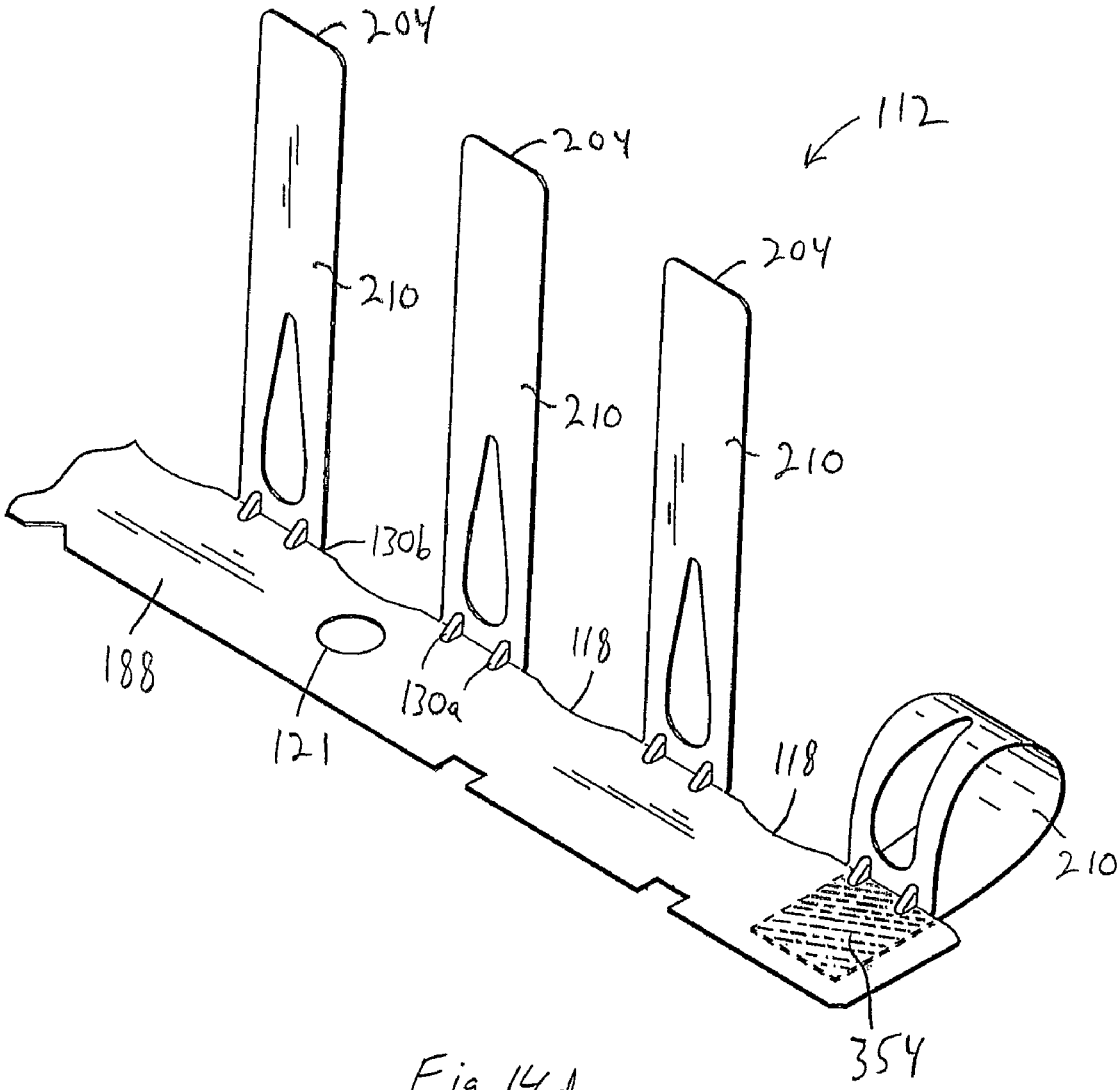
FIG. 14*d* is a top perspective view of a portion of an individual binding element from the stack of binding elements of FIG. 5, illustrating multiple bends and gussets formed in the individual binding element by the bending and gusseting mechanism, and illustrating a free end of a finger of the binding element looped around and secured to a spine of the binding element via a weld.
Figure 14E:
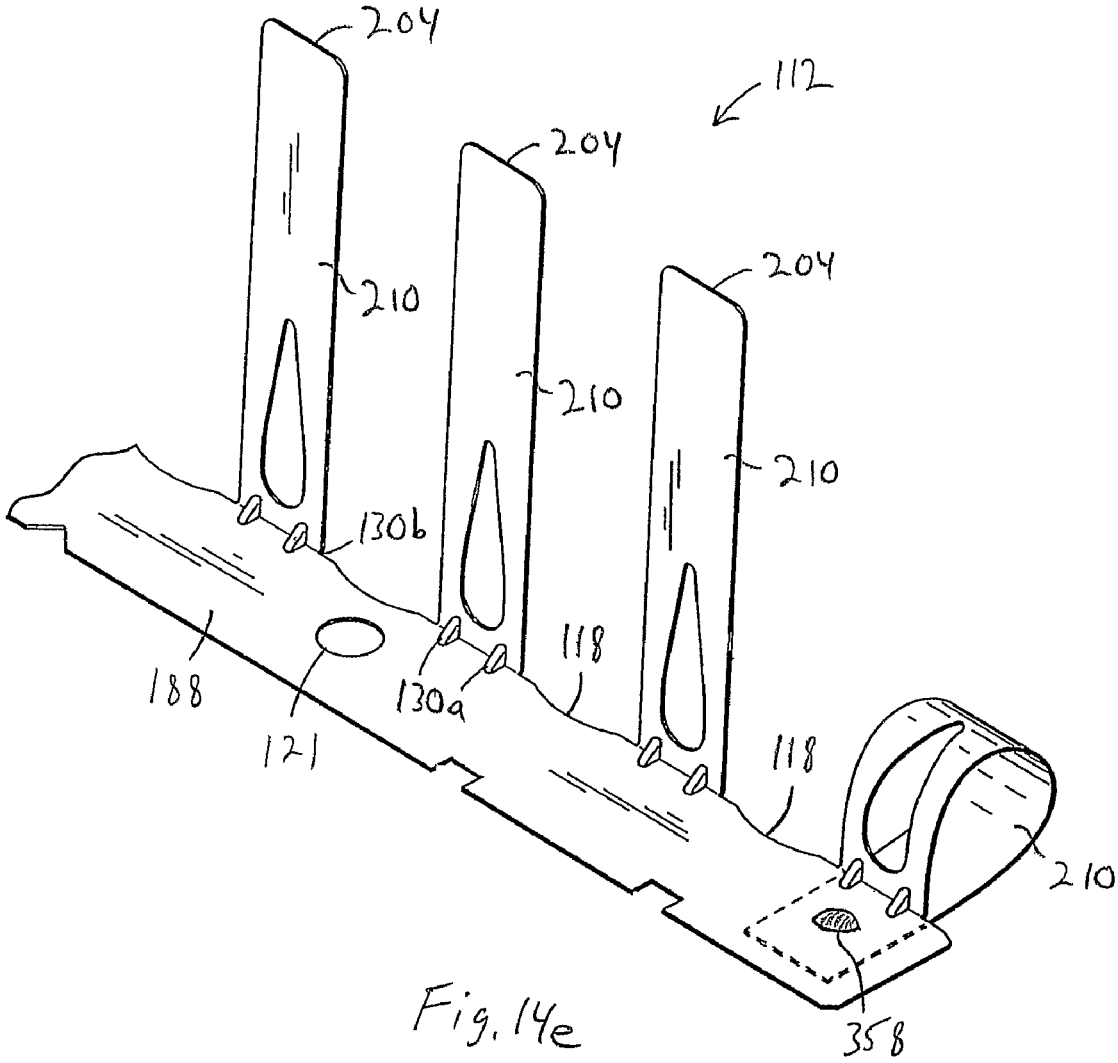
FIG. 14*e* is a top perspective view of a portion of an individual binding element from the stack of binding elements of FIG. 5, illustrating multiple bends and gussets formed in the individual binding element by the bending and gusseting mechanism, and illustrating a free end of a finger of the binding element looped around and fastened to a spine of the binding element via a mechanical fastener.
Figure 14F:
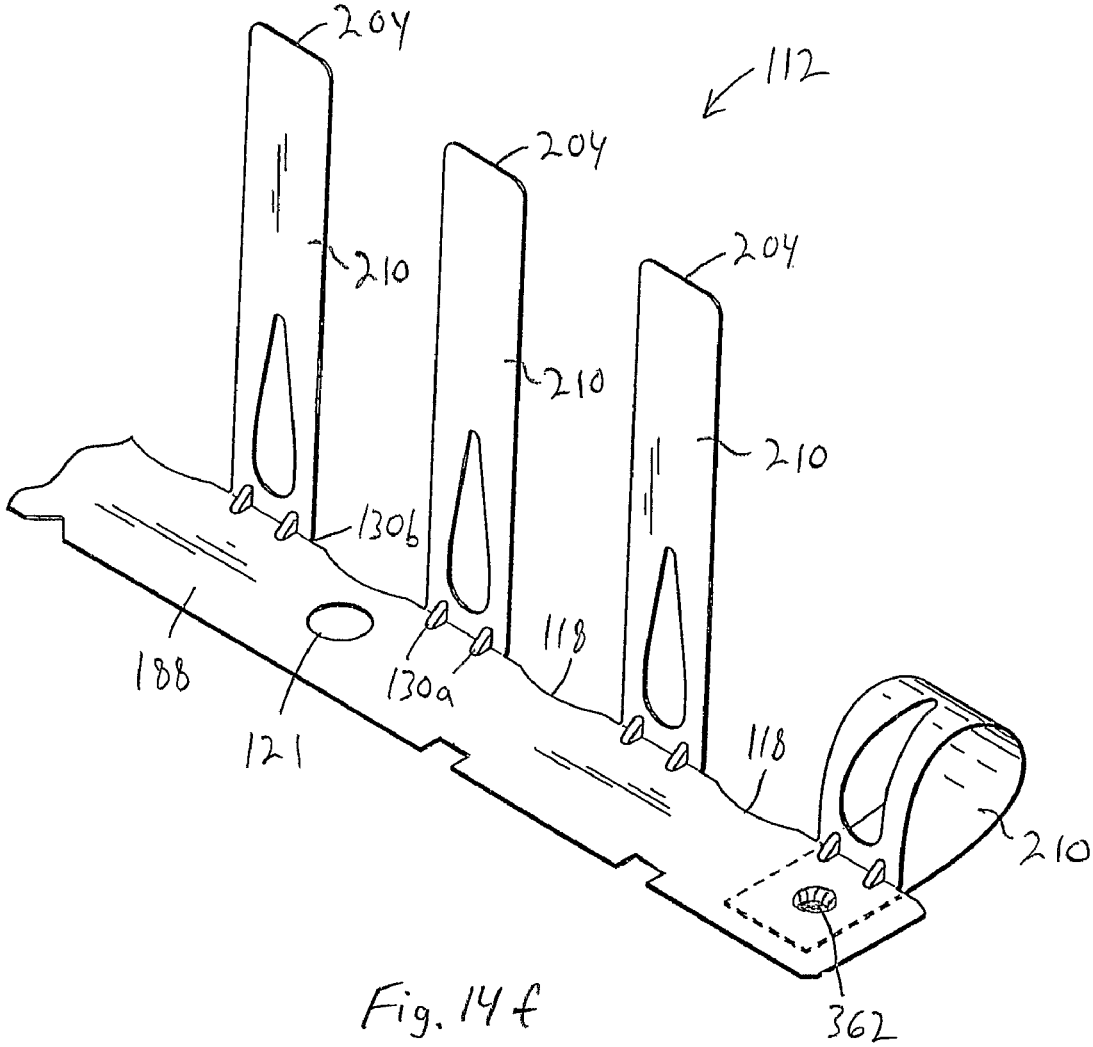
FIG. 14*f* is a top perspective view of a portion of an individual binding element from the stack of binding elements of FIG. 5, illustrating multiple bends and gussets formed in the individual binding element by the bending and gusseting mechanism, and illustrating a free end of a finger of the binding element looped around and deformably coupled to a spine of the binding element.

With reference to FIGS. 5 and 6, the feeder 110 also includes an alignment member 119 projecting through respective apertures 121 in the spines 188 of the binding elements 112 (see also FIGS. 14*a* and 14*b*). Like the supports 114, 116, the alignment member 119 may provide lateral or side-to-side alignment of the stack of binding elements 112 in the feeder mechanism 110 and also prevents a user from improperly loading the binding elements 112 into the feeder mechanism 110 in the wrong orientation. However, the alignment member 119 may also serve as a brand-specific identifier for the automated binding machine 50. In other words, one brand of automated binding machine 50 may position the alignment member 119 in the location shown in FIGS. 5 and 6 so that a particular brand or supply of binding elements 112, which have apertures 121 in corresponding locations, must be utilized. Other brands or supplies of binding elements 112, having apertures in alternative locations other than that shown in FIGS. 14*a* and 14*b*, would not be usable in the feeder mechanism 110 of FIGS. 5 and 6 because of the misalignment between the alignment member 119 and the alternative aperture locations in the binding elements 112.

Figure 14G:
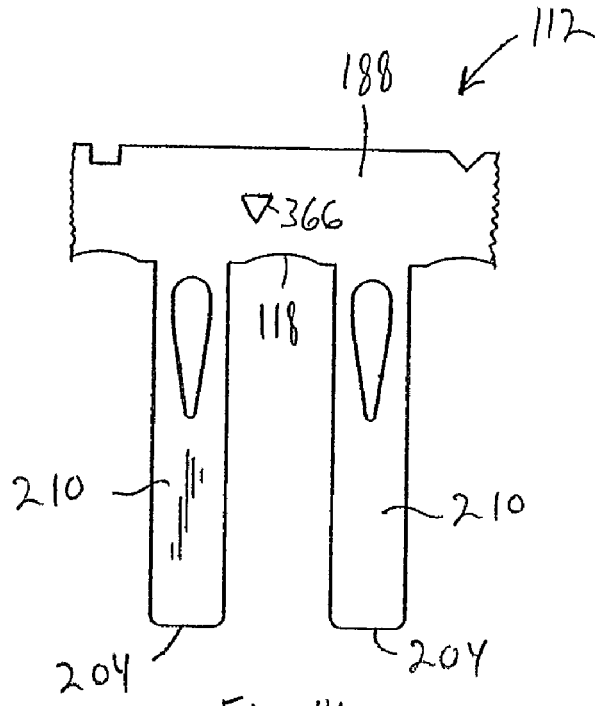
FIG. 14*g* is a top view of a portion of an individual binding element having an alternatively configured alignment aperture in a first orientation.

Rather than providing a circular alignment aperture 121 or changing the location of the aperture 121, the binding element 112 may include an alternatively-configured alignment aperture 366, such as the triangular alignment aperture 366 illustrated in FIG. 14*g*. The alignment aperture 366 may be configured in any of a number of different ways (e.g., different shapes, different sizes, different orientations such as the orientation of the alignment aperture 366' in FIG. 14*h*) to serve as a brand-specific identifier of the binding elements 112.

Figure 14H:
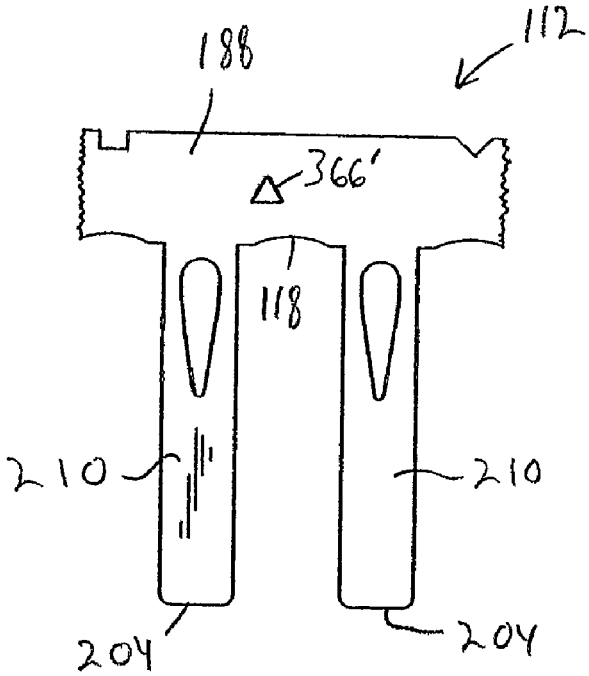
FIG. 14*h* is a top view of a portion of an individual binding element having an alternatively configured alignment aperture in a second orientation.
Figure 15:
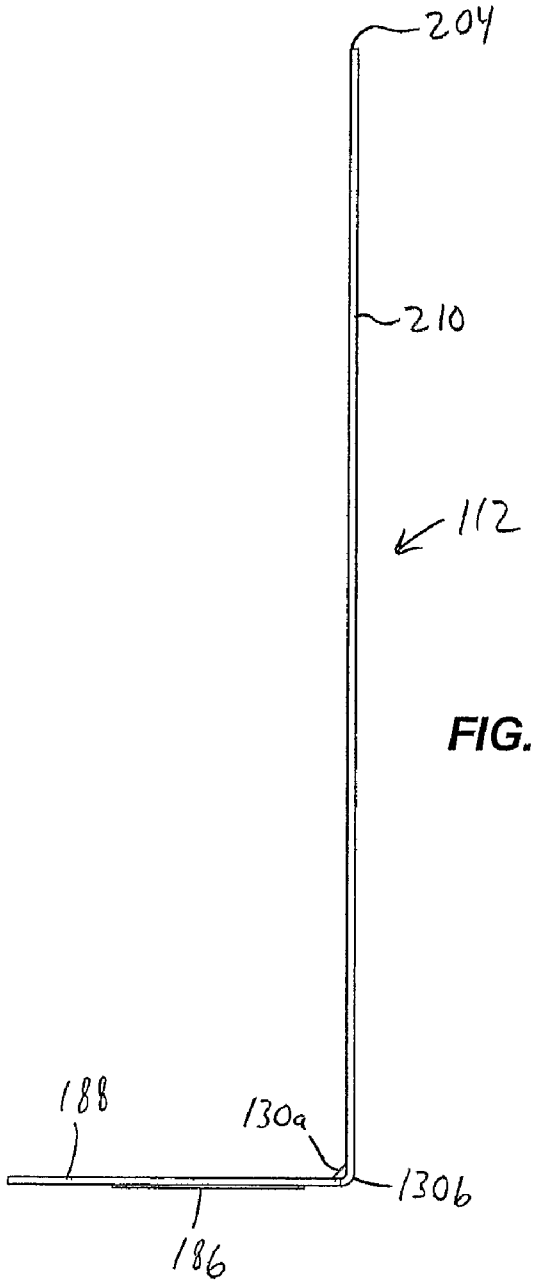
FIG. 15 is a side view of the binding element of FIGS. 14*a* and 14*b*.
Figure 16:
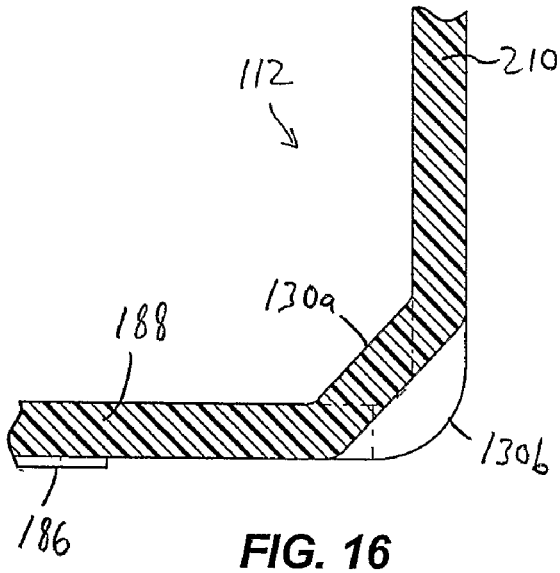
FIG. 16 is an enlarged, cross-sectional view of the binding element of FIGS. 14*a* and 14*b* through line 16-16 in FIG. 14*a*.

Rather than relocating the alignment member 119, different configurations (e.g., different shapes, sizes, and orientations) of the alignment member can be used to distinguish between different brands of binding elements 112 (e.g., a triangular cross-sectional shape to receive triangular aperture 366, see FIG. 14*g*), and/or the alignment member may be re-oriented to receive brand-specific binding elements 112 (e.g., those binding elements 112 in FIG. 14*h* having the differently-oriented triangular alignment aperture 366').

Figure 7A:
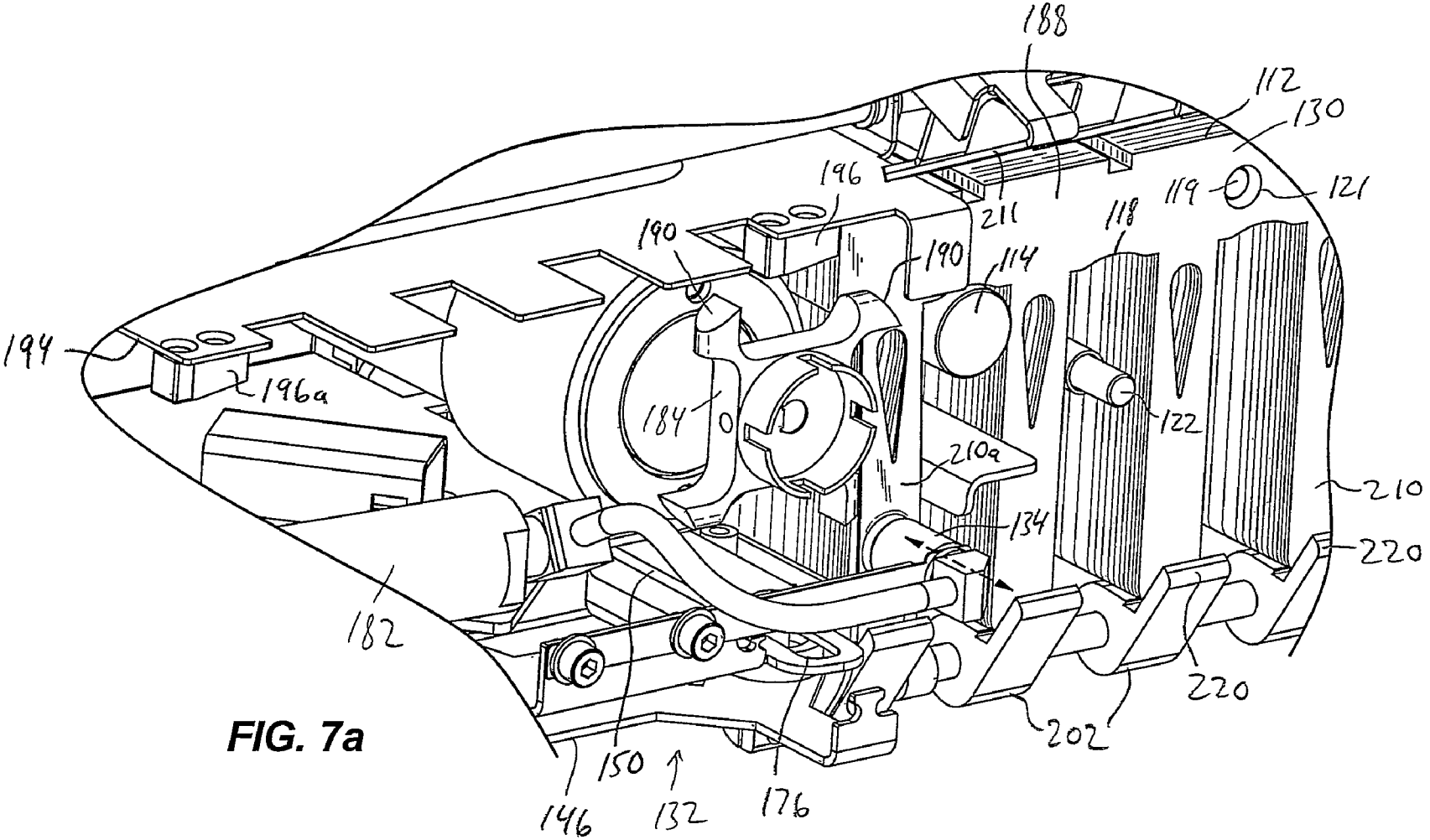
FIG. 7*a* is a fragmentary perspective view of the binding element feeder of FIG. 5, illustrating the suction member at least partially separating an individual binding element from the stack of binding elements.

With reference to FIG. 5, in order to separate a forward-most binding element 130 from the stack of binding elements 112, the binding element feeder 110 includes a separation mechanism having a number of subassemblies. While the separation mechanism is described with regard to these subassemblies, it should be appreciated that the separation mechanism may be alternately structured and include entirely different components, or one or more of the presently described components, alone, or in combination with the structure described herein or other appropriate structure. In the illustrated embodiment, the separation of the forward-most binding element 130 from the stack of binding elements 112 is initiated by a suction subassembly 132. The suction subassembly 132 includes a suction member or a suction cup 134 through which a vacuum or suction is drawn. With additional reference to FIG. 7*a*, the suction cup 134 is positioned toward the distal end 204 of one of the fingers 210*a* of the binding element 130 toward one end of the binding element 130, and suction is drawn. The suction cup 134 is pulled away from the stack of binding elements 112, exerting an outward force on the finger 210*a* of the binding element 130 such that the finger 210*a* of the binding element 130 is bowed away from the stack of binding elements 112. By way of example only, the initiation of separation may alternatively be accomplished by mechanisms such as an edge pick or friction members.

Returning to the illustrated embodiment in FIGS. 5-7*a*, both the movement of the suction cup 134, and the suction drawn therethrough are governed by a camming mechanism 138. The camming mechanism 138 includes a cam 140 that rotates about an axis 142, a cam follower 144, and a four bar linkage 146 coupled to the rotating cam 140 by an L-shaped linkage 147 at coupling 148. The movement of the four bar linkage 146 as governed by the rotation of the cam 140 and the movement of the L-shaped linkage 147 governs the movement of the suction cup 134 supported thereon toward, onto, and away from the finger 210*a* of the binding element 130. The linkage 146 may be seen more clearly in the lower perspective view of FIG. 6. Parallel links 150, 152 are pivotably secured on ends 154, 156, respectively to the frame or other stationary support member 158, while the other ends 160, 162, respectively are pivotably coupled to opposite ends of a link 164. The L-shaped link 147 is pivotably coupled at one end 170*a* to the cam 140 by another link 148. The apex 174 of the L-shaped linkage 147 is pivotably coupled to the four bar linkage 146 at 162. The other end 170*b* of the L-shaped link 147 (i.e., at the end of the other leg) is slidably coupled to four bar linkage 146, the movement of the end 170*b* being governed by a channel 176. In this way, the movement of the L-shaped link 147 at its apex 174 is governed by the rotation of the cam 140 and the pivoting of parallel links 150, 152. As the cam 140 rotates, the L-shaped link 147 is pivoted toward or away from the finger 210*a* of the binding element 130. The movement of the end 170, upon which the suction cup 134 is supported, is additionally governed by the limitations of the channel 176. It should thus be appreciated by those of skill in the art that the suction cup 134 is advanced toward the finger 210*a* of the binding element 130, and then dropped down against the surface of the finger 210*a* of the binding element 130. The suction cup 134 is then lifted away from the stack of binding elements 112 to lift the tip 204 of the finger 210*a* of the binding element 130. The suction cup 134 is subsequently moved away from the front of the stack of binding elements 112, the significance of which is described below.

The actual suction drawn through the suction cup 134 is likewise governed by the rotation of the cam 140 in the illustrated embodiment. More specifically, the cam follower 144 is coupled to a spring-loaded piston 180 within a cylinder 182. As the cam 140 rotates, the piston 180 is biased outward from the cylinder 182 as the cam follower 144 follows the peripheral surface of the rotating cam 140. As the piston 180 moves outward, it draws a vacuum within the cylinder 182. This vacuum is transmitted to the suction cup 134 by way of a coupling tube 183. It should be appreciated that the rotation of the cam 140 is timed such that the piston 180 moves outward from the cylinder 182 to draw the vacuum just as the suction cup 134 is placed upon the finger 210*a* of the binding element 130. In this way, the suction cup 134 remains under suction as it pulls the finger 210*a* of the binding element 130 away from the stack of binding elements 112 for further engagement and separation of the forward-most binding element 130 from the stack of binding elements 112. It should be appreciated by those of skill in the art that the suction may be developed by an alternative arrangement, such as, for example, a vacuum pump. The illustrated embodiment, however, has the advantage that both the movement of the suction cup 134 and the suction drawn therethrough are governed by a single motor.

Figure 7B:
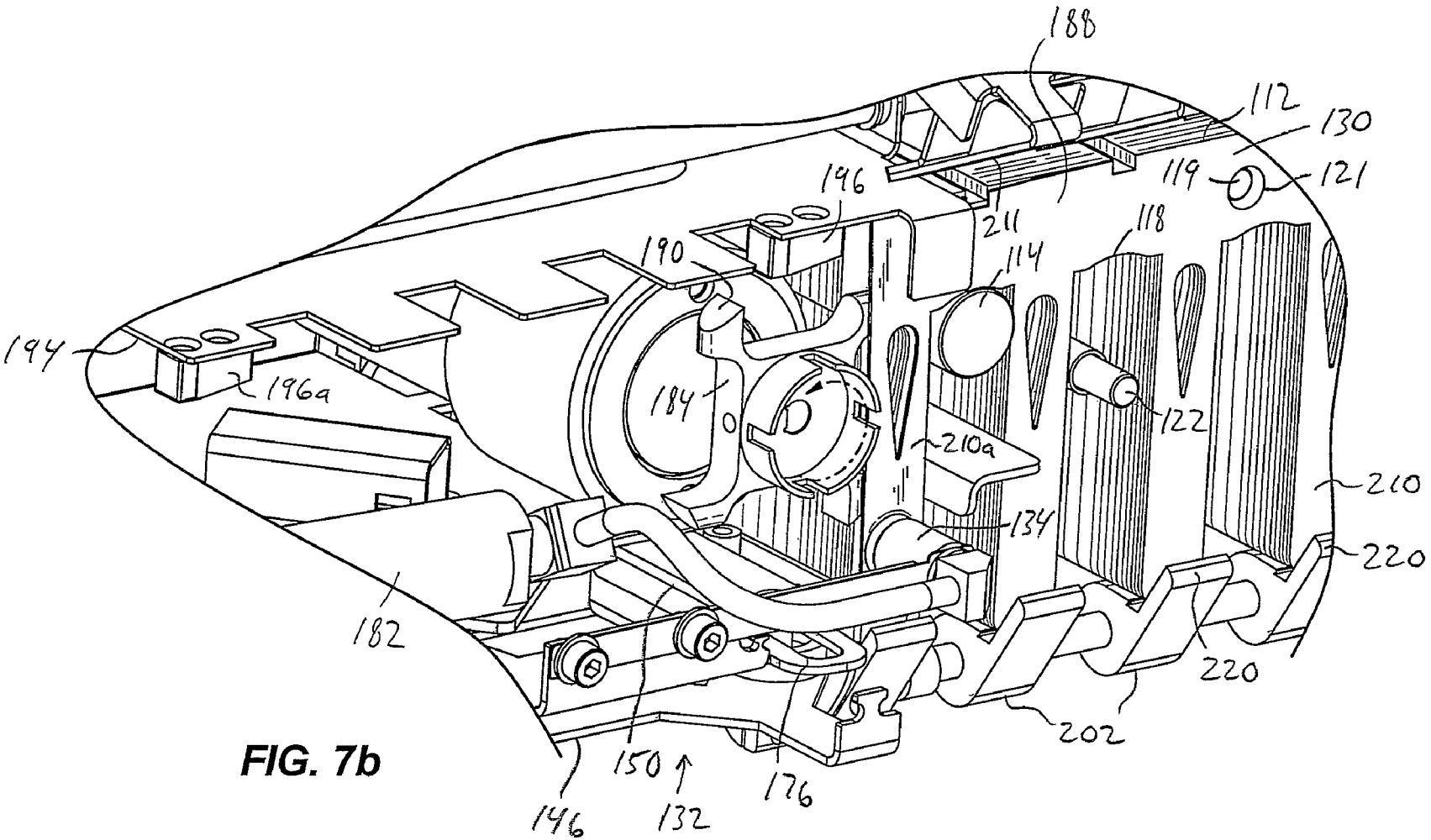
FIG. 7*b* is a fragmentary perspective view of the binding element feeder of FIG. 5, illustrating the rotary separator at least partially separating an individual binding element from the stack of binding elements.
Figure 7C:
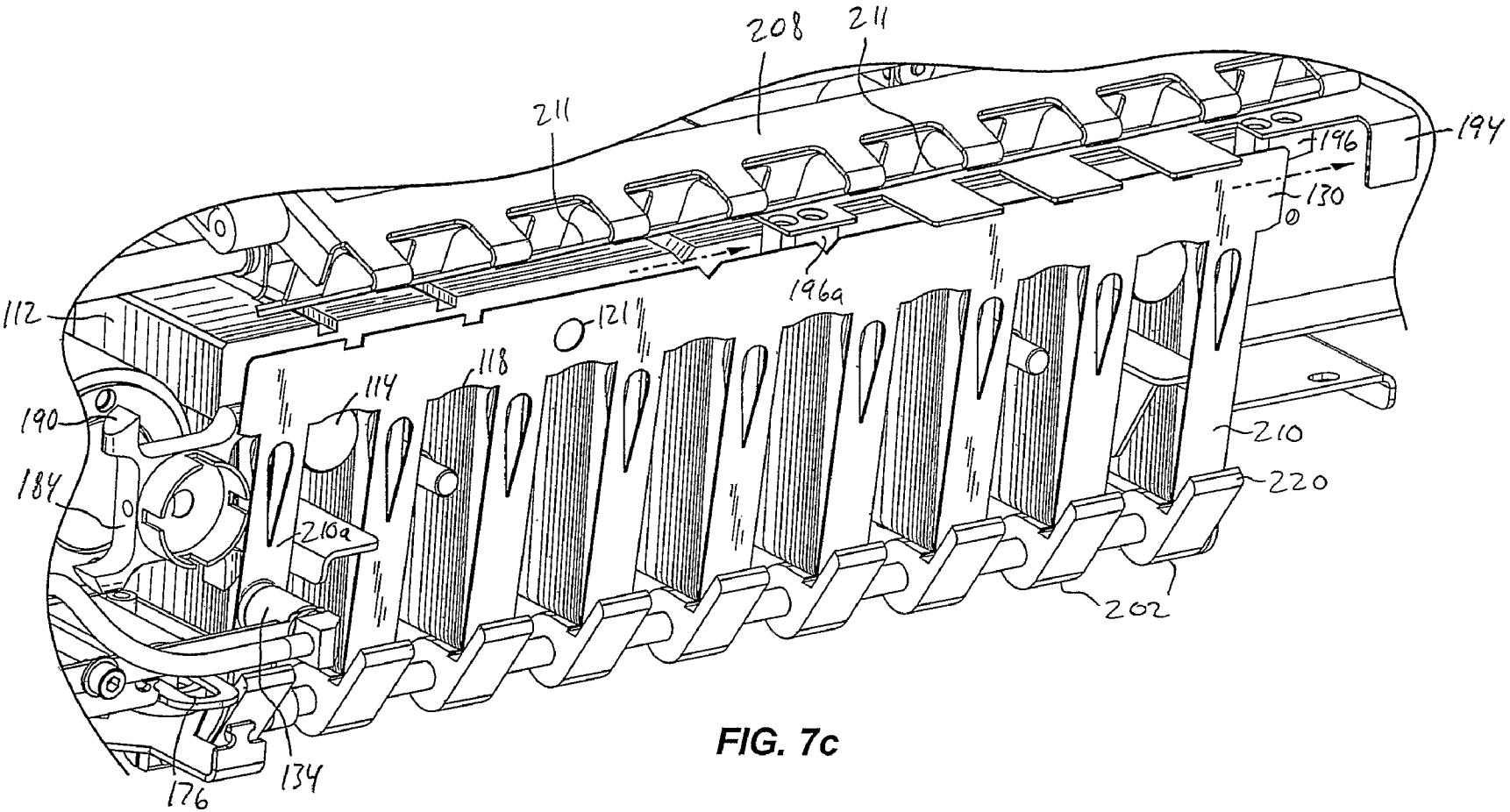
FIG. 7*c* is a fragmentary perspective view of the binding element feeder of FIG. 5, illustrating the sliding separator at least partially separating an individual binding element from the stack of binding elements.

With reference to FIGS. 5, 6, and 7*b*, once separation of the forward-most binding element 130 is initiated by the finger 210*a* of the binding element 130 being arched away from the stack of binding elements 112, further separation of the forward-most binding element 130 from the stack of binding elements 112 is provided by a separator 184 that further separates the finger 210*a* of the binding element 130 and a portion of the spine 188 of the forward-most binding element 130 from the stack of binding elements 112, thus separating at least one spot of adhesive 186 (see FIG. 14*b*) on the spine 188 of the forward-most binding element 130 from the stack of binding elements 112. The illustrated separator 184 is in the form of a rotating element or a rotating member from which a plurality of ramped protrusions or projecting edges 190 extend. Specifically, the rotary separator 184 includes four projecting edges 190, however, any number of projecting edges 190 (e.g., 2, 3, 5, etc.) may be utilized. With reference to FIG. 7*b*, as the rotary separator 184 rotates in a counter-clockwise direction, one of the projecting edges 190 enters the space formed between the finger 210*a* of the binding element 130 and the adjacent stack of binding elements 112, to separate the end of the spine 188 from the stack of binding elements 112. It should be appreciated that once the projecting edges 190 of the separator 184 rotates to separate the forward-most binding element 130 from the stack of binding elements 112, it remains in position adjacent the separated binding element 130 such that it retains the remaining stack of binding elements 112 to the rear.

Following this separation, the remaining portion of the spine 188 with its adhesive 186 is separated from the remaining stack of binding elements 112 by a linearly-movable member, or a sliding or a gliding separator 192 that progressively separates the remaining spots of adhesive 186 along the length of the spine 188. The gliding separator 192 moves from the partially-separated end of the binding element 130 to the opposite end of the binding element 130 to complete the separation of the forward-most binding element 130 from the stack of binding elements 112 (see FIG. 7*c*). In the illustrated embodiment, the gliding separator 192 is in the form of a movable trolley 194 having one or more ramped separators or projecting edges 196 configured to move between the spine 188 of the forward-most binding element 130 and the remaining stack of binding elements 112, and progressively separate the same. In the illustrated construction of the separator 192, two projecting edges 196 are utilized, however, any number of projecting edges 196 (e.g., 3, 4, 5, etc.) may be used by the separator 192.

To retain the stack of binding elements 112 in position during this separation process, a retaining guide (not shown) may be provided at the end of the stack of binding elements 112 opposite the rotating separator 184. Such a retaining guide may be similar to that shown and described in the previously-referenced U.S. Provisional Patent Application Ser. Nos. 60/708,579 and 60/709,710. As the trolley 194 with the projecting edges 196 moves toward the retaining guide 200, the retaining guide may be moved out of engagement with the remaining portion of the stack of binding elements 112. The trolley 194 eventually comes to rest with the projecting edge 196*a* disposed along the end of the stack of binding elements 112 to retain the stack of binding elements 112 in position. Upon eventual return of the trolley 194 to the opposite end of the stack of binding elements 112, the retaining guide may return to its biased or home position at the end of the stack of binding elements 112 opposite the rotating separator 184.

With reference to FIGS. 5-7*c*, to prevent the now separated forward-most binding element 130 from dropping within the machine 50 due to the force of gravity or from becoming otherwise dislodged, the binding element feeder 110 is further provided with a retaining mechanism. In the illustrated embodiment, the retaining mechanism is in the form of a plurality of fingertip stays 202. When in position against the tips 204 of the fingers 210 of the binding element 130, the stays 202 hold the tips 204 of the fingers 210 of the binding element 130 adjacent to the stack of binding elements 112. The fingertip stays 202 are mounted within the binding element feeder 110 such that they may be moved out of engagement with the binding element 130 and the stack of elements 112 when retention is no longer required. While they may be alternatively mounted, the plurality of stays 202 in the illustrated embodiment are rotatably mounted such that they may be simultaneously rotated out of engagement with the tips 204 of the fingers 210 of the separated binding element 130.

Figure 8:
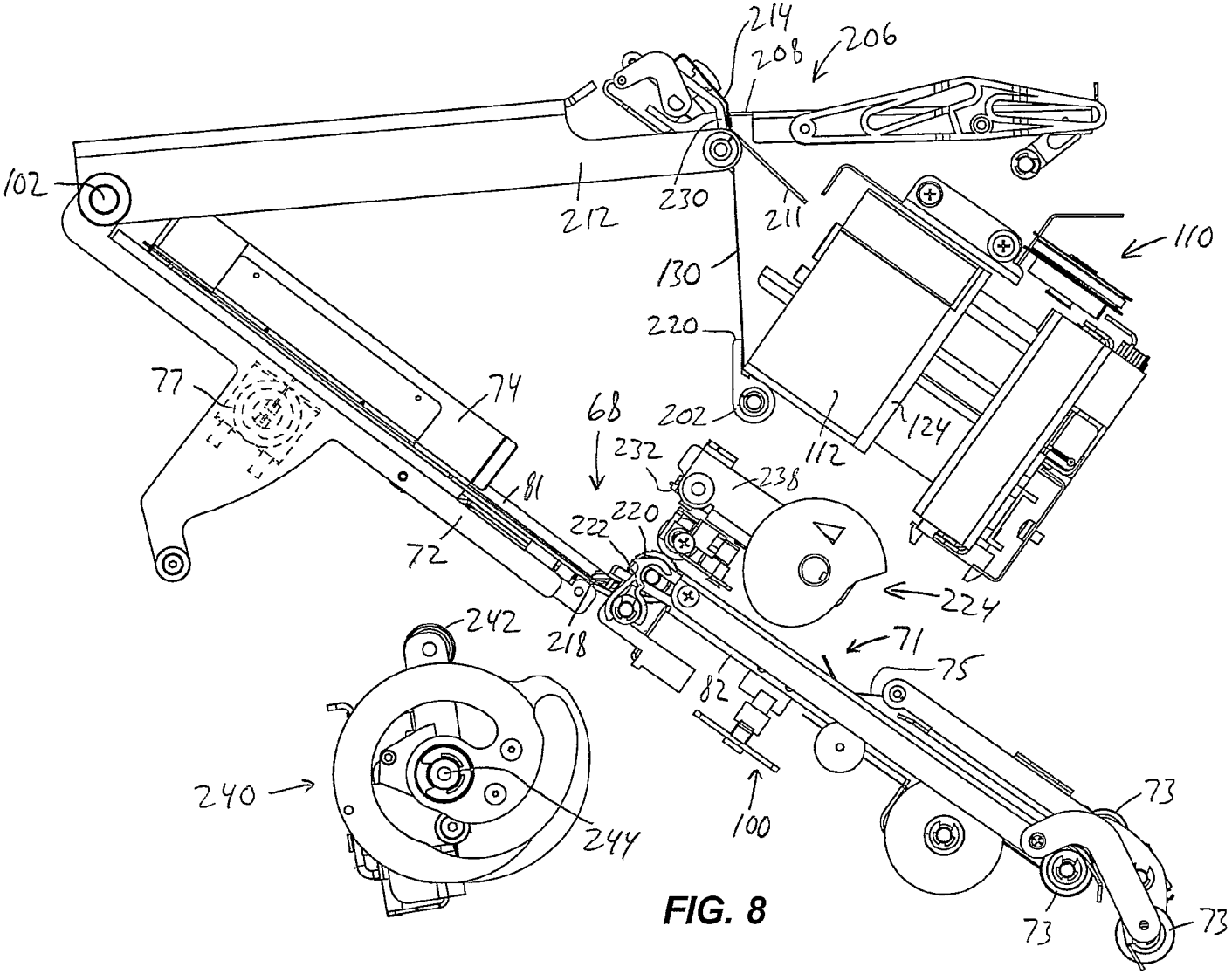
FIG. 8 is a fragmentary side view of the stacker, the receiving member, and the binding element feeder of FIGS. 2*a* and 3-7*c*, illustrating additional mechanisms of the automated binding machine including a binding element positioner, a bending and gusseting mechanism, and a binding mechanism constructed in accordance with teachings of the invention.
Figure 9:
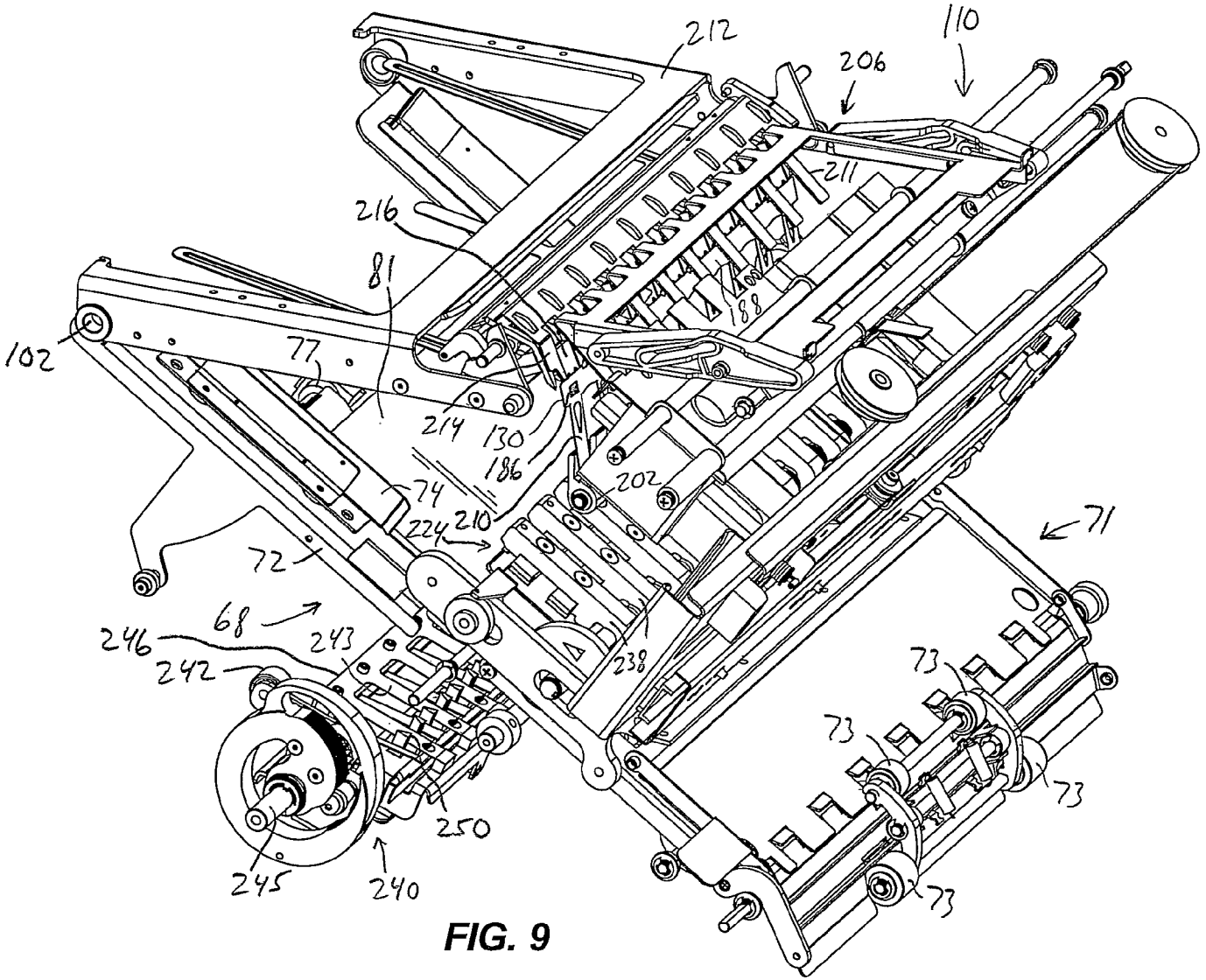
FIG. 9 is a top perspective view of the mechanisms of FIG. 8.

With reference to FIGS. 5, 6, 8, and 9, to further transmit the now separated forward-most binding element 130 from the remaining stack of binding elements 112, the binding element feeder 110 further includes an element positioner 206. While the positioner 206 may be of any appropriate design, the illustrated positioner 206 includes a movable bar 208 from which a plurality of fingers 211 extend. As shown in FIGS. 8 and 9, the positioner 206 pushes the separated binding element 130 further from the stack of binding elements 112 and into a position for access by a pivoting receiving member or clamp 212 that further advances the element 130 through the binding process. Once the separated binding element 130 is pushed from the stack of binding elements 112, the pivoting clamp 212 pivots downward to clamp the spine 188 of the separated binding element 130. As shown in FIG. 9, the pivoting clamp 212 includes a plurality of clamping elements 214 that receive and clamp the spine 188 of the separated binding element 130 between the portions of the spine 188 having the spots of adhesive 186 and between adjacent fingers 210. The surface of the spine 188 disposed opposite the spots of adhesive 186 are positioned adjacent one or more surfaces 216 along the clamp 212. The significance of this structure will become apparent upon further explanation. Once the spine 188 of the separated binding element 130 is grasped by the clamp 212, the finger tip stays 202 are rotated out of engagement such that they no longer support the separated binding element 130. As with the other components of the binding element feeder 110, it should be appreciated that the positioner 206 as well as the clamp 212 may be of alternative designs.

Figure 10:
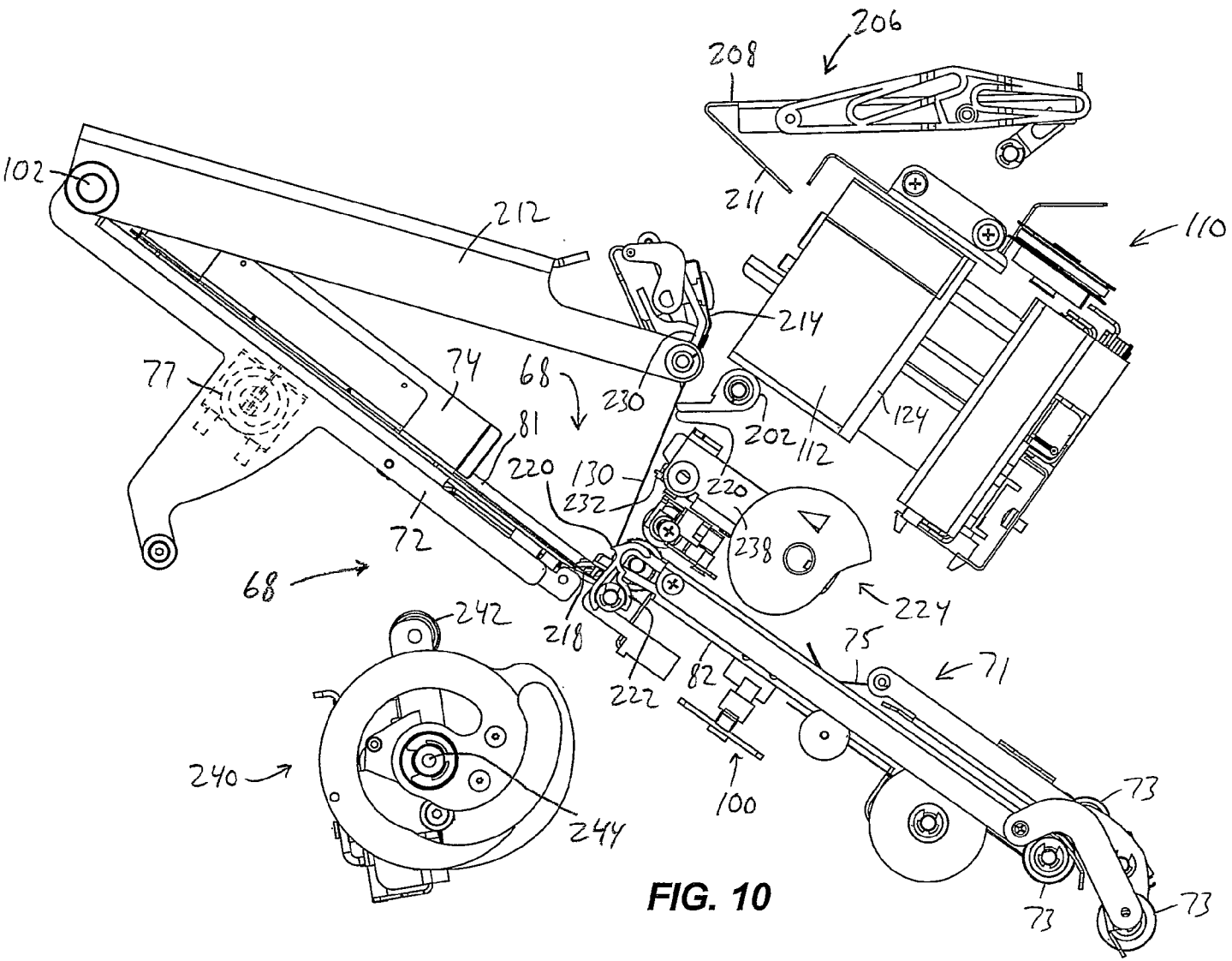
FIG. 10 is a fragmentary side view of the mechanisms of FIG. 8, illustrating an individual binding element positioned in the receiving member and moved toward a stack of perforated sheets supported in the support member.
Figure 11:
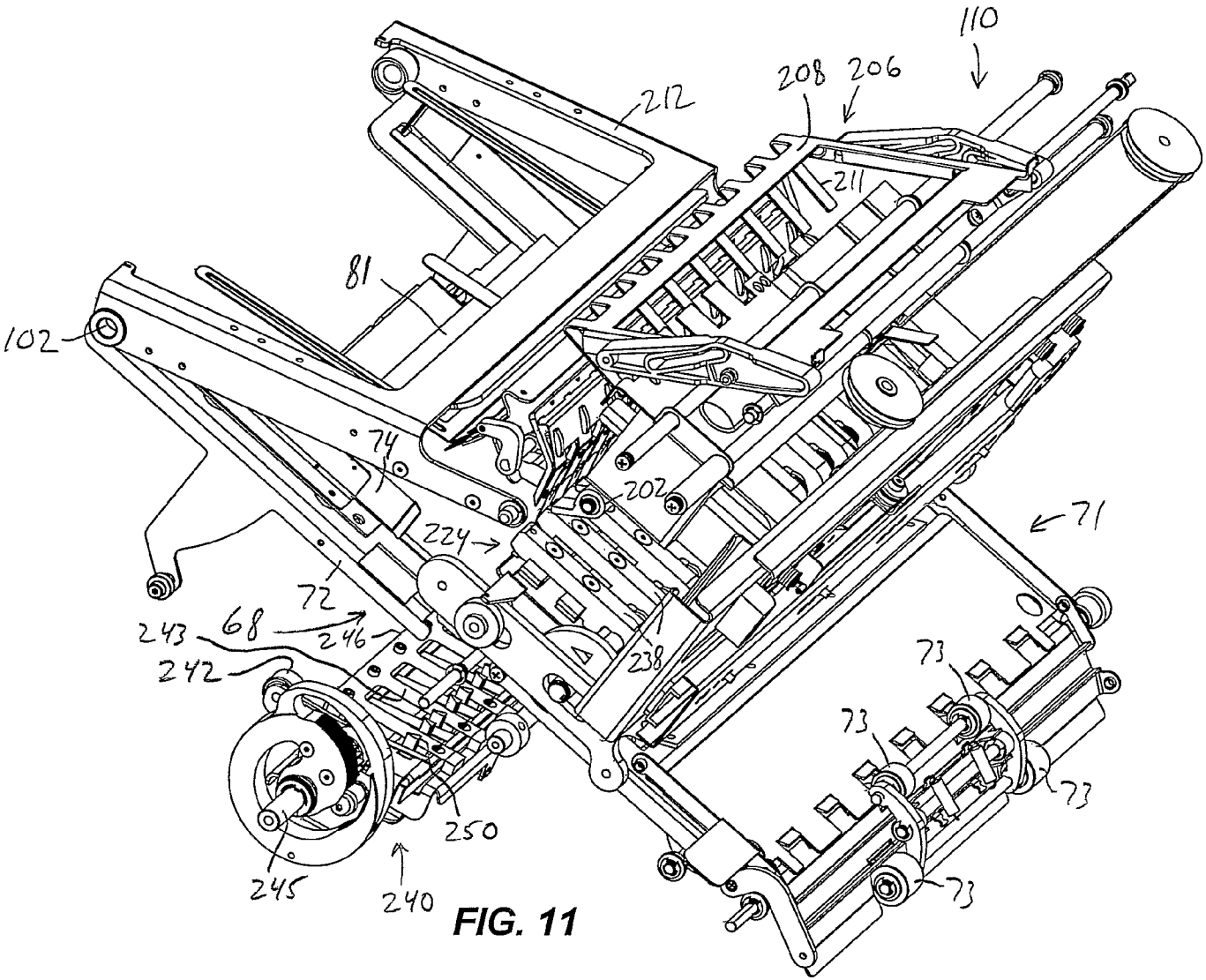
FIG. 11 is a top perspective view of the mechanisms and individual binding element of FIG. 10.

With reference to FIGS. 10 and 11, the pivoting clamp 212 with the separated binding element 130 pivots downward toward the stack 81 of sheets supported on the tray 72. To properly position and guide the fingers 210 of the separated binding element 130 into the perforations 218 in the stack 81 of sheets, one or more ramped surfaces 220, including surfaces of the rotated finger tip stays 202, may be positioned to direct the fingers 210 of the binding element 130. In the illustrated embodiment, a plurality of arms 222 are additionally provided that pivot outward from the stacker 68 to guide the fingers 210 of the separated binding element 130 into the perforations 218.

Figure 12:
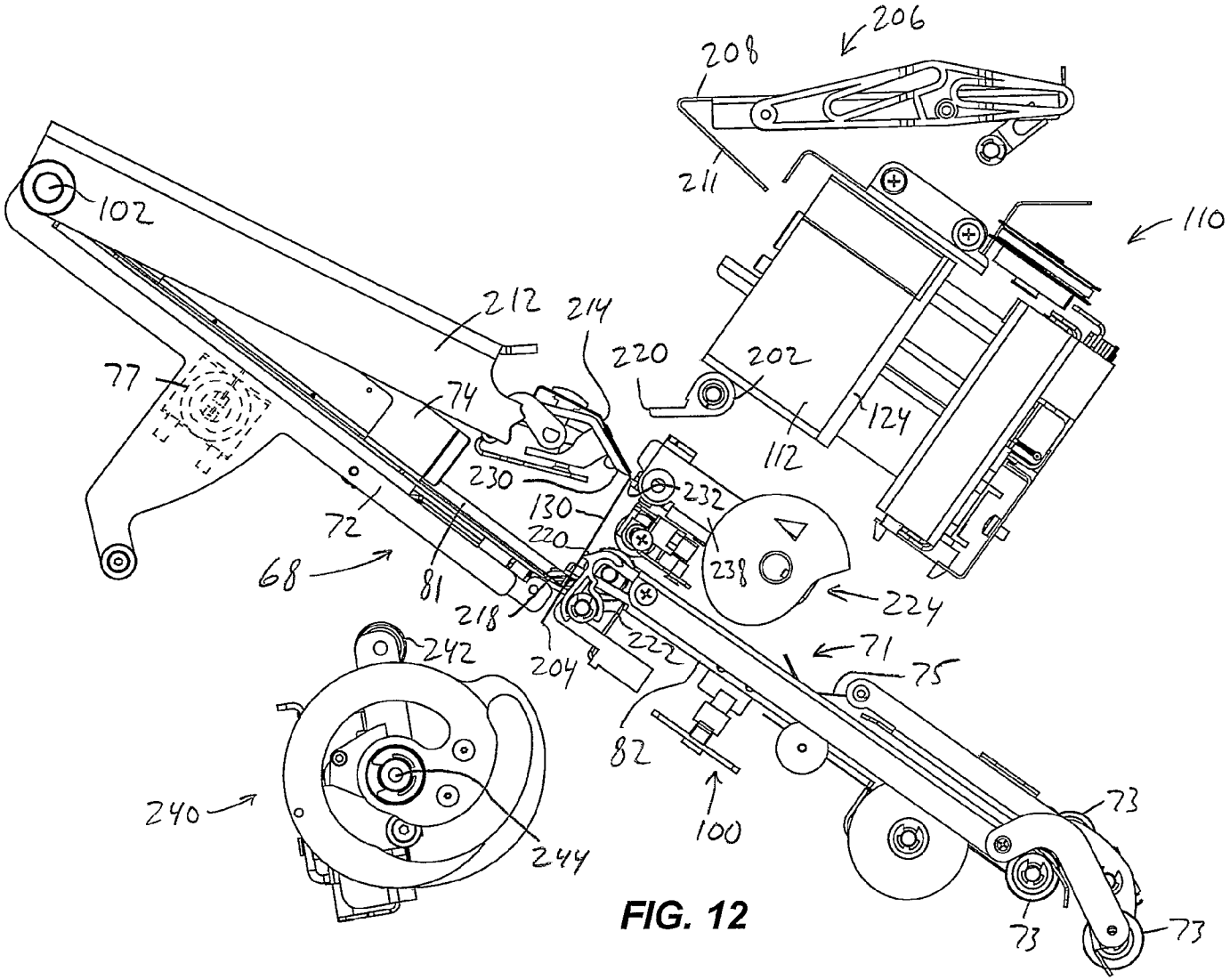
FIG. 12 is a fragmentary side view of the mechanisms of FIG. 8, illustrating the bending and gusseting mechanism forming bends and gussets in the individual binding element positioned in the receiving member.
Figure 13:
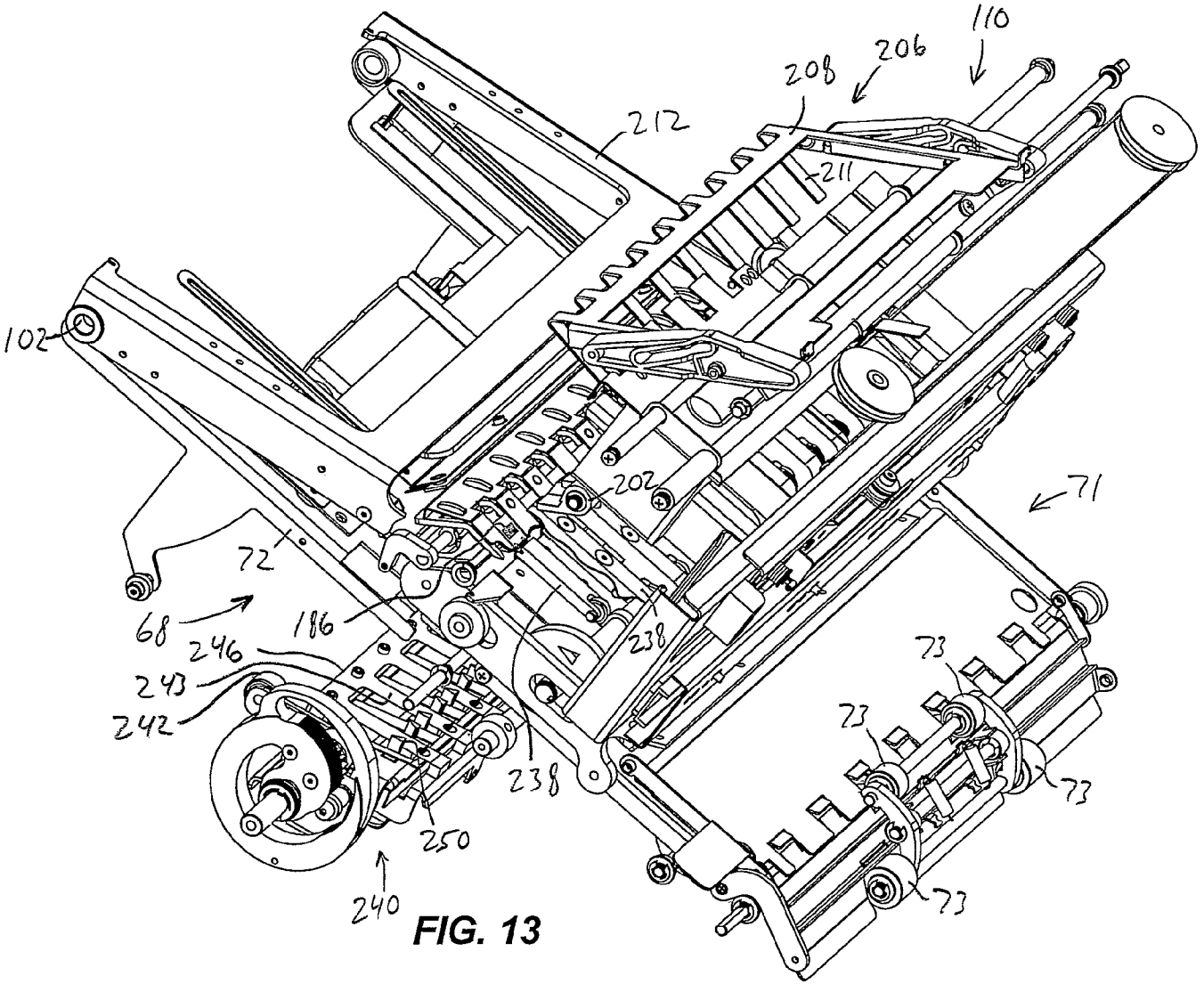
FIG. 13 is a top perspective view of the mechanisms and individual binding element of FIG. 12.

In order to obtain a finally bound element that closely resembles a round shape, the separated binding element 130 may be bent and preferably provided with a gusset 130*a* to inhibit the straightening or relaxation of the bent binding element 130 (as shown, for example, in FIGS. 14*a*-16). As shown in FIG. 1, the machine 50 may be provided with a bending and gusseting assembly 224. As best shown in FIGS. 12 and 13, the pivoting clamp 212 pivots downwardly to insert the fingers 210 of the separated binding element 130 into the perforations 218, and to dispose the base 130*b* of the fingers 210 adjacent the bending and gusseting assembly 224. While inserting the fingers 210 into the perforations 218, the head of the clamp 212 may rotate to bend the separated binding element 130 near the respective bases 130*b* of the fingers 210. The bending and gusseting assembly 224 further preferably includes a plurality of male dies 230 secured to the head of the pivoting clamp 212, and a plurality of mating female dies 232 slidably coupled to a frame of the gusseting assembly 224 (see FIGS. 12 and 13). The female dies 232 include a pair of pins disposed on slides 238. In operation, the slides 238 move forward toward the male dies 230 to plastically deform the separated binding element 130 to form gussets 130*a* at the bend in the base 130*b* of the fingers 210. It should be appreciated, however, that the bending and gusseting operations may alternatively be performed simultaneously. The fingers 210 may be bent to a relatively sharp angle, for example, to angles ranging from less than 90° to approximately 120° relative to the spine 188, such that the sharp corner will be maintained regardless of springback or relaxation.

Figure 17:
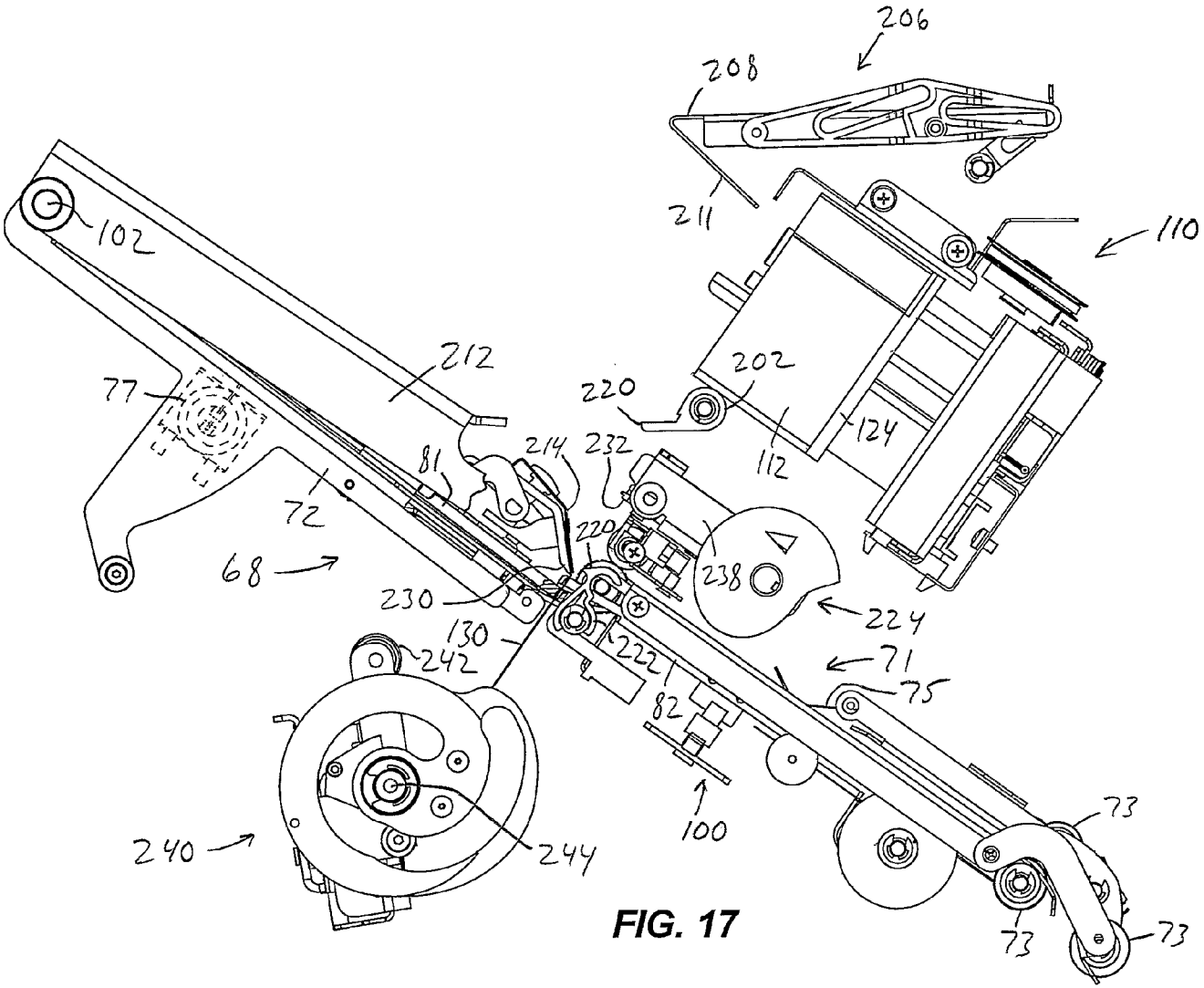
FIG. 17 is a fragmentary side view of the mechanisms of FIG. 8, illustrating the individual binding element being inserted through perforations in the stack of perforated sheets.
Figure 18:
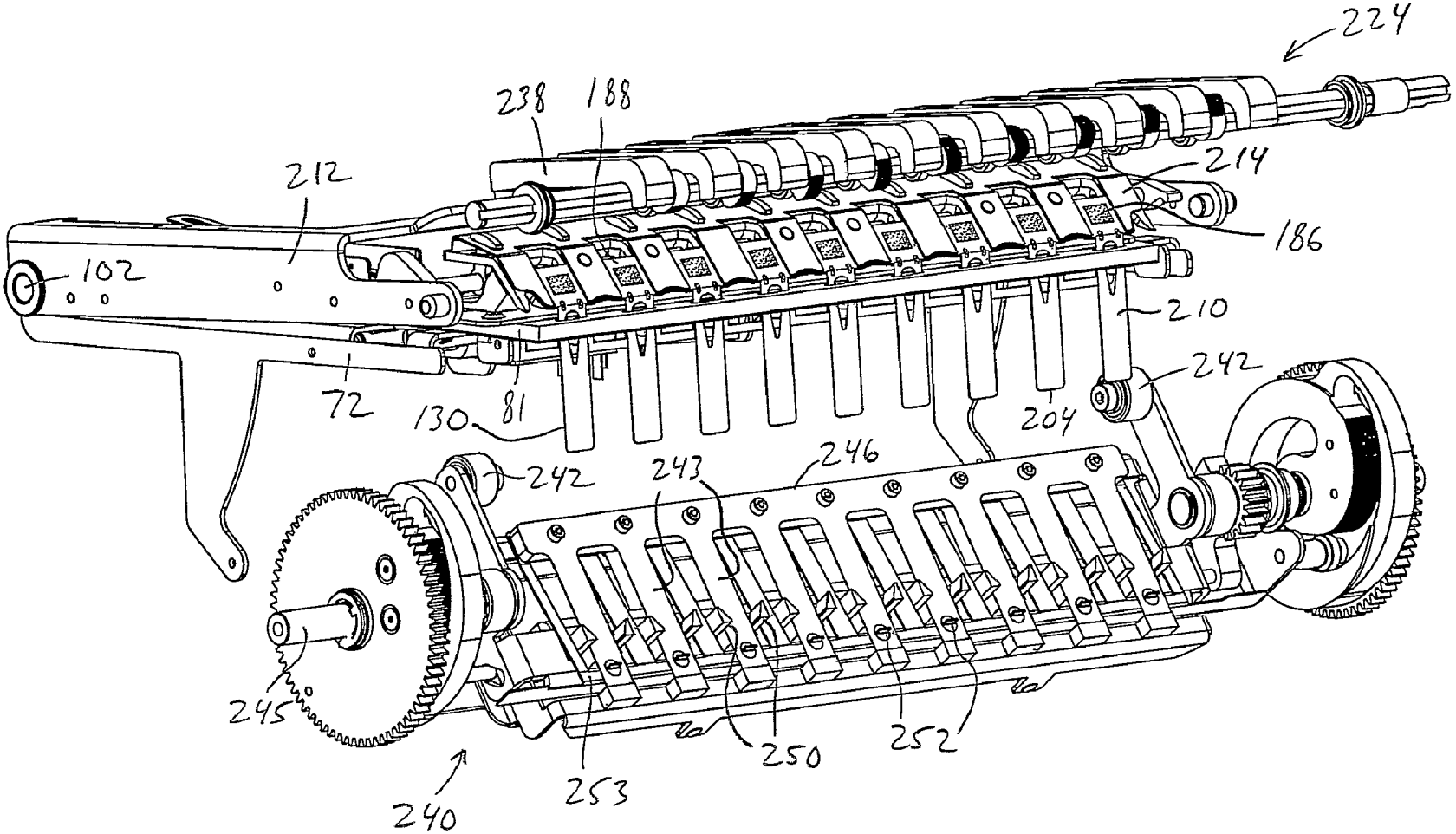
FIG. 18 is a rear perspective view of the binding mechanism, the bending and gusseting mechanism, the receiving member, and a portion of the stacker of FIG. 17.
Figure 19:
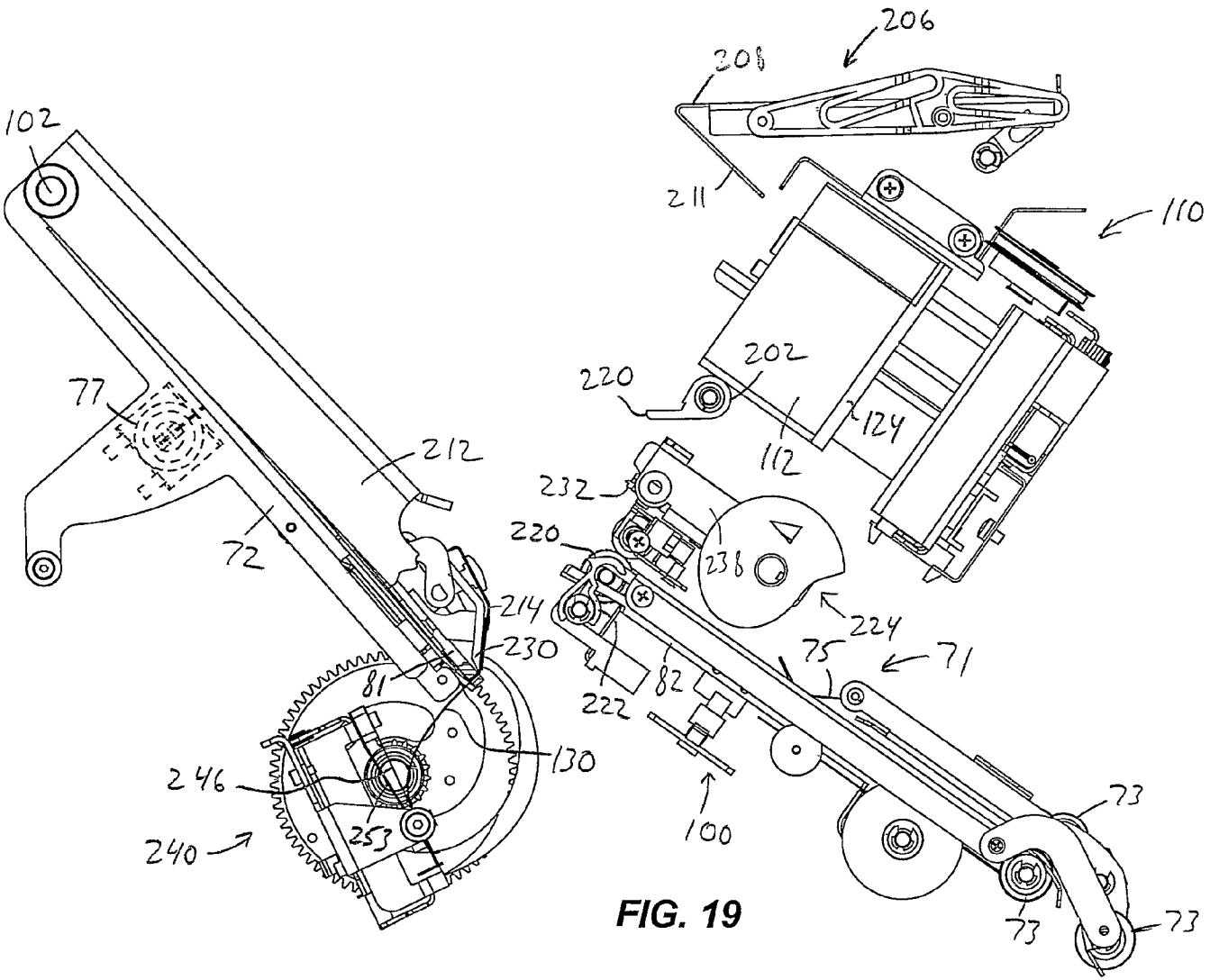
FIG. 19 is a fragmentary side view of the mechanisms of FIG. 8, illustrating the binding mechanism engaging the respective fingers of the individual binding element to loop the respective fingers around the stack of perforated sheets.
Figure 20:
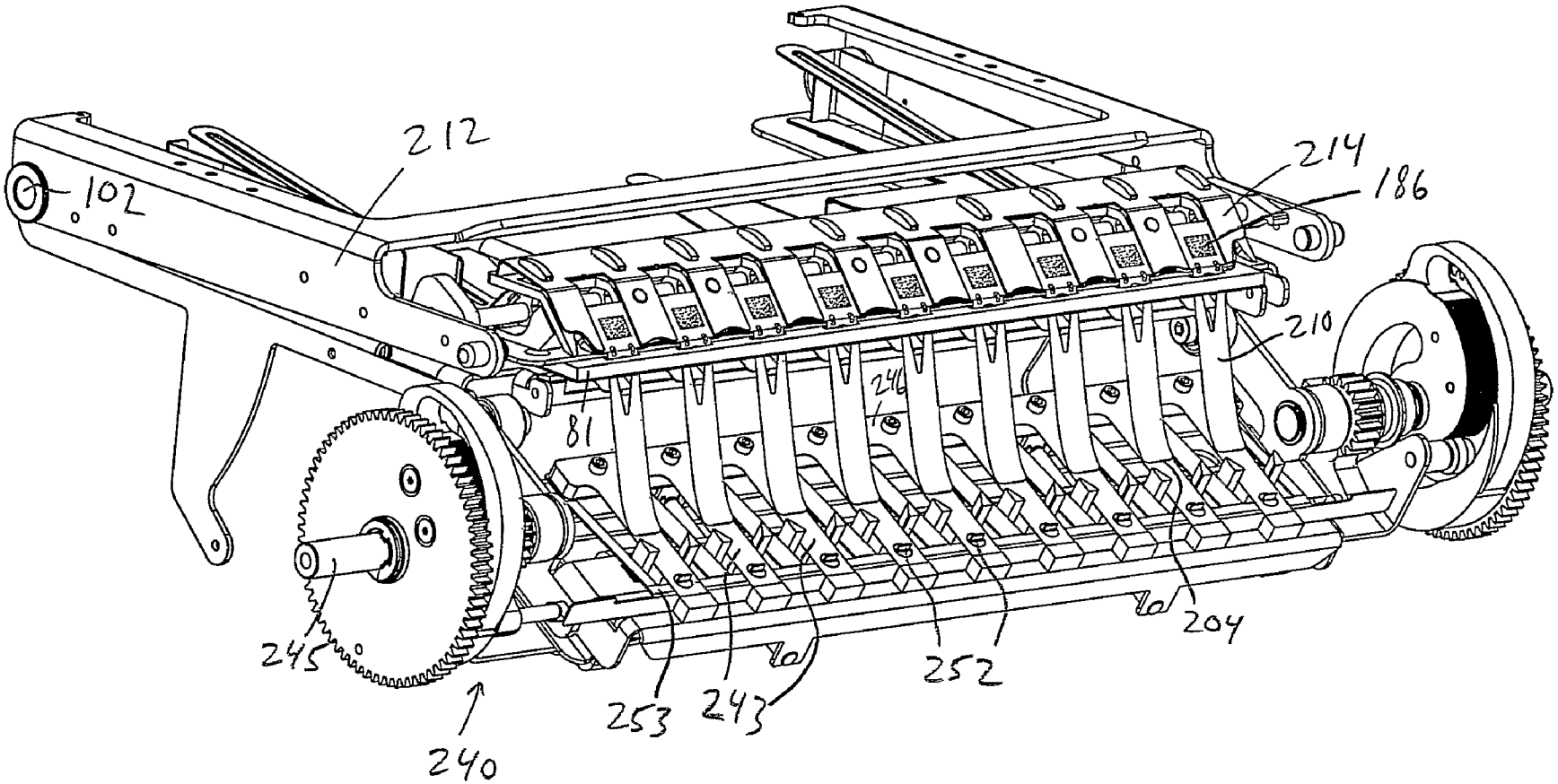
FIG. 20 is a rear perspective view of the binding mechanism, the receiving member, and a portion of the stacker of FIG. 19.

With reference to FIGS. 17 and 18, with the fingers 210 bent at their respective bases 130*b*, the pivoting clamp 212 continues to move downward to complete the insertion of the fingers 210 into the perforations 218 in the stack 81 of sheets. As the pivoting clamp 212 moves toward the tray 72, the pivoting clamp 212 and tray 72 continue to pivot downward toward a closure or loop, size and seal mechanism or a binding mechanism 240 (see also FIG. 1). As the tray 72 approaches the binding mechanism 240, the cam followers 242 ride along a lower surface of the tray 72 to cause the mechanism 240 to begin to rotate about a pivot point 244. As the binding element 130 approaches the mechanism 240, the fingers 210 of the binding element 130 slide along a plurality of parallel surfaces 243 of a flexible sealing bracket 246 as the mechanism 240 pivots, causing the fingers 210 to loop as they slide (see FIGS. 19 and 20). As the fingers 210 slide along the surfaces 243, they are guided by guides 250, the finger tips 204 continuing to slide along the surfaces 243 until such time as the tips 204 abut tip stops 252 disposed toward the ends of the surfaces 243. In this way, the tip stops 252 prevent the tips 204 from sliding further along the surfaces 243 as the mechanism 240 loops the tips 204 toward the spine 188.

Figure 21:
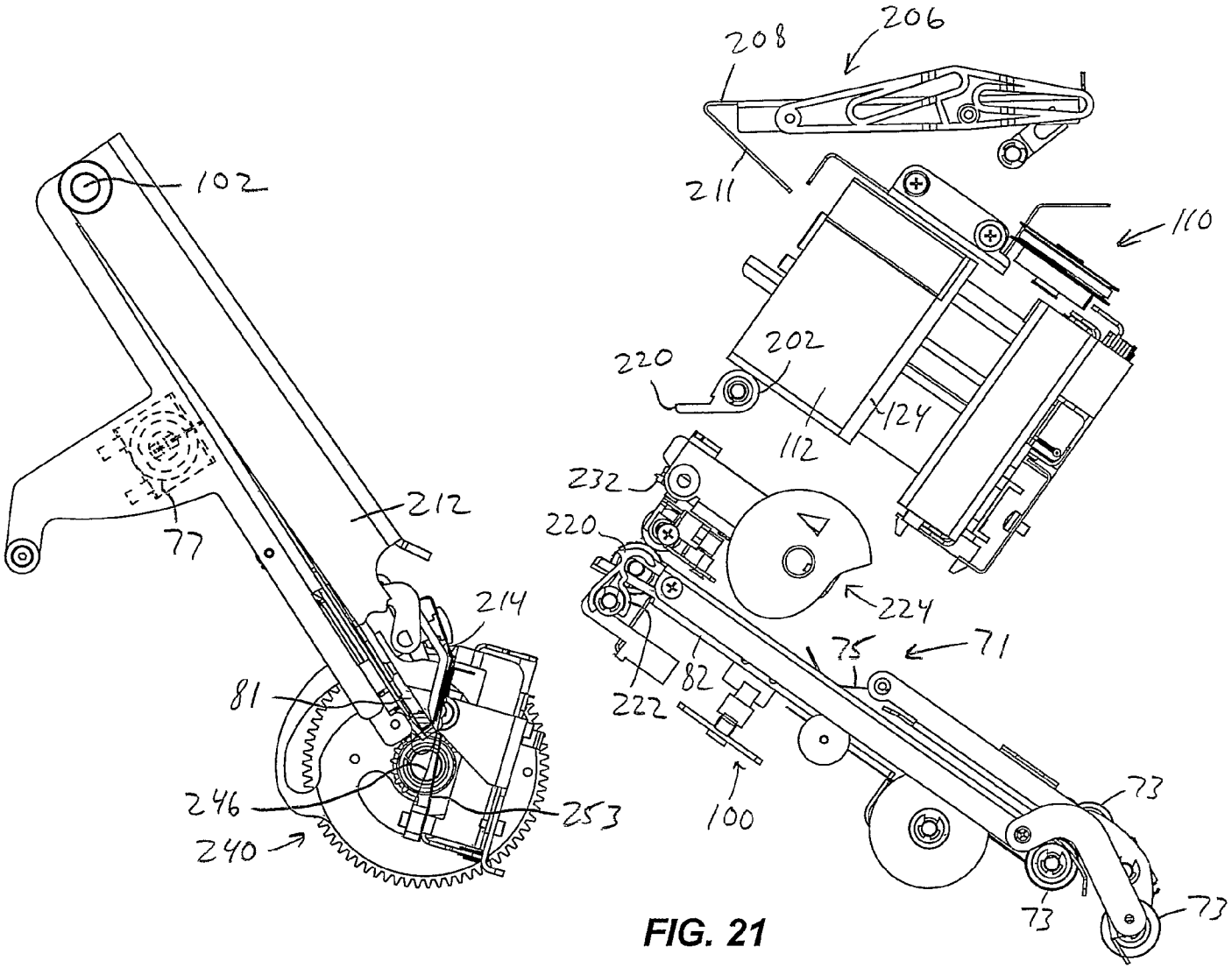
FIG. 21 is a fragmentary side view of the mechanisms of FIG. 8, illustrating the binding mechanism in a position such that the free ends of the respective fingers are adjacent the spine of the binding element.
Figure 22:
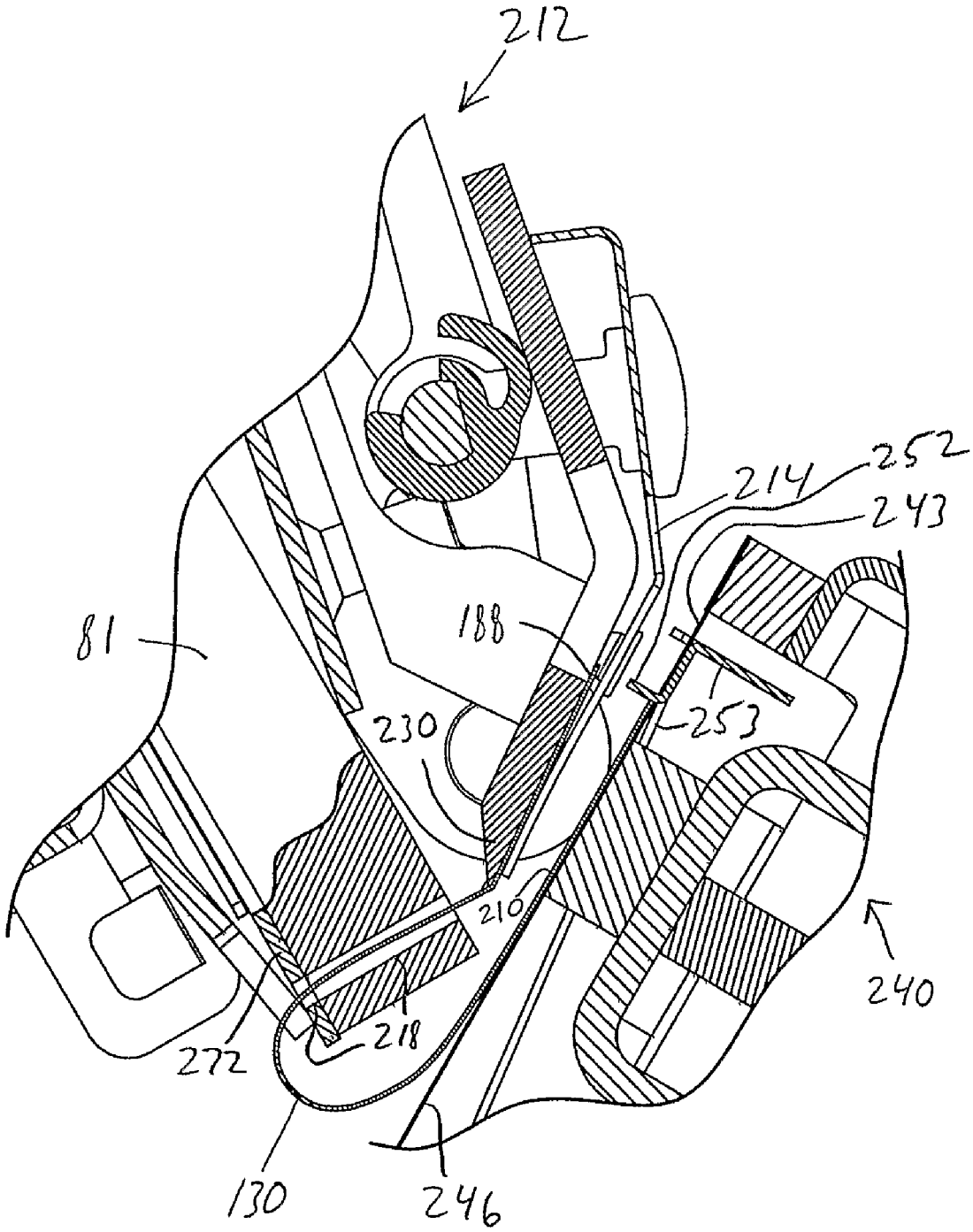
FIG. 22 is an enlarged, side view of a portion of the binding mechanism, receiving member, and individual binding element of FIG. 21, illustrating the individual binding element binding a relatively large stack of perforated sheets.
Figure 23:
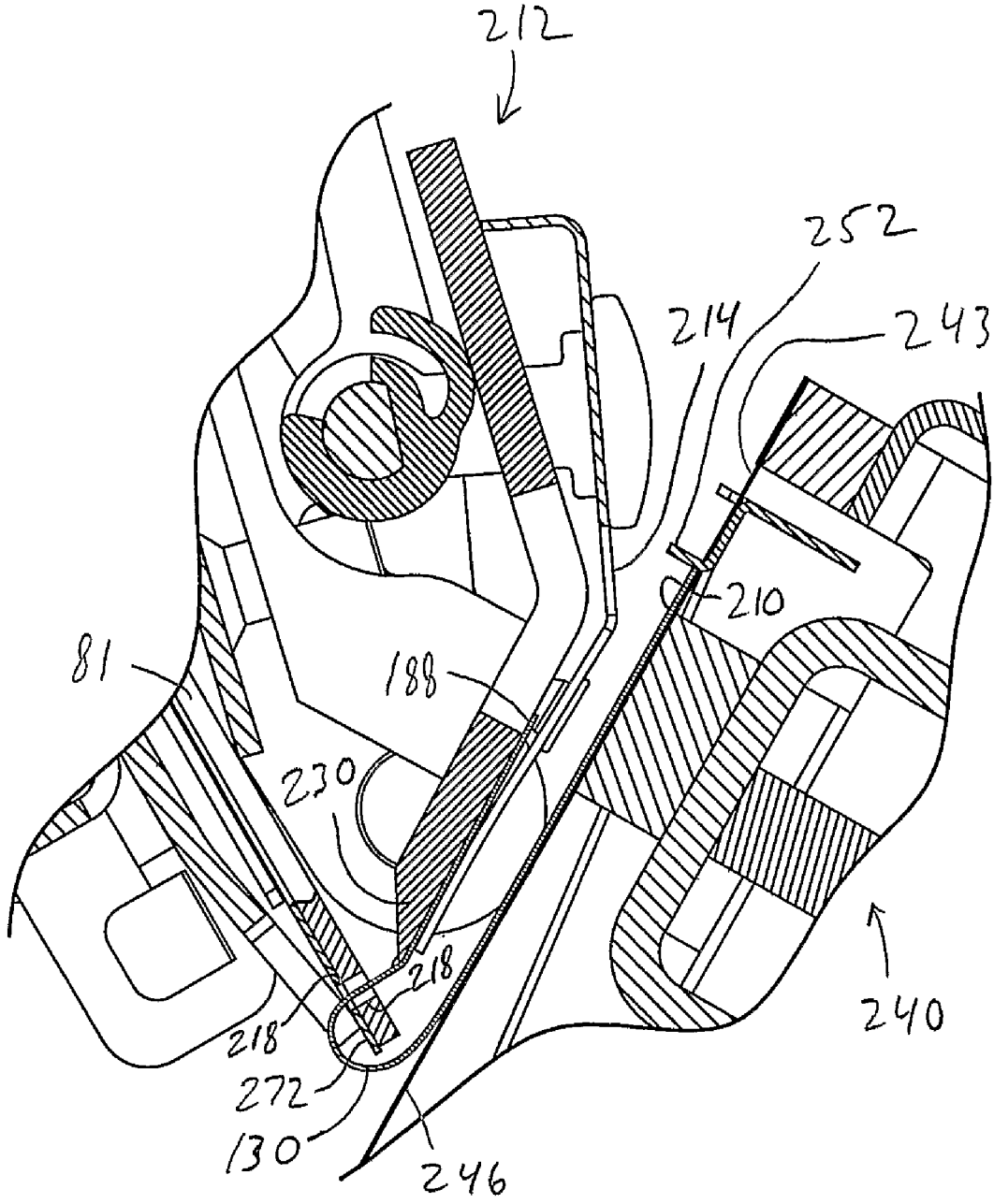
FIG. 23 is an enlarged, side view of a portion of the binding mechanism, receiving member, and individual binding element of FIG. 21, illustrating the individual binding element binding a relatively small stack of perforated sheets.

With reference to FIGS. 21-23, according to one embodiment, the tip stops 252 are spring biased by spring steel 253. As a result, as the flexible sealing bracket 246, with the fingers 210 disposed on the surfaces 243, approaches the male die plate 230 as shown in FIG. 22, the fingertip stops 252 retract into the respective surfaces 243 as the surfaces 243 continue to move toward the spine 188 of the binding element 130. In this way, the surfaces 243 press the fingers 210 against the adhesive 186 positioned along spine 188 to couple the fingers 210 to the spine 188 to complete the book. The mechanism 240 is subsequently rotated back to its initial position and the clamp 212 is pivoted upwardly to receive another binding element 112.

In order to provide quality binding of different heights or thicknesses of stacks 81 of sheets, the binding mechanism 240 forms a smaller or larger loop (i.e., an appropriately-sized loop) based upon the height or thickness of the stack of sheets 81. This can be referred to as dynamic sizing. It should be appreciated by those of skill in the art that the relative position of the pivot point 244 of the binding mechanism 240 (as determined by the pivot shaft 245, see FIGS. 18 and 20) to the tray 72 determines the position at which the binding element fingers 210 will be positioned along the adhesive 186 on the spine 188. While the relative positions may be determined by any appropriate arrangement, in one embodiment, movement of the tray 72 as a stack 81 of sheets is formed thereon is sensed by the sensor 100 and transmitted to the binding mechanism 240 via a gearing mechanism, which positions the mechanism 240 relative to the tray 72 to provide appropriately-sized loops of the binding element fingers 210 and sealing pressure during placement of the fingers 210 along the adhesive 186 on the spine 188. As shown in FIG. 23, when a small-sized stack 81 of sheets is bound, the fingertip stop 252 may extend entirely beyond the male die plate 230 of the pivoting clamp 212. This is the result of the fingers 210 in the binding element 130 forming a smaller loop to accommodate the thinner stack 81 of sheets, such that the tips 204 of the respective fingers 210 are spaced further from the spine 188 of the binding element 130. Because the same binding element 130 may be configured, during the dynamic sizing process described above, to form relatively large loops (see FIG. 22) or relatively small loops (see FIG. 23), any of a number of different appropriately-sized loops may be formed by the binding element 130 to accommodate a wide range of thicknesses of the stack 81 of perforated sheets. It should be appreciated that alternative arrangements may be provided for establishing the relative positions of the tray 72, pivoting clamp 212, and binding mechanism 240, and for providing an appropriate loop, size and seal.

Once the stack 81 of sheets is bound, the binding mechanism 240 is rotated out of engagement and the pivoting clamp 212 disengages and pivots away from the bound book. Returning to FIG. 1, the bound book then drops due to the force of gravity to a rotatably mounted foam covered wheel 260. As the wheel 260 rotates, the bound book passes through a nip 262 formed with a plate 264 and is deposited in a spring-loaded tray 266 within an output bin 268. In other embodiments, the tray 266 may be static or stationary instead of spring-loaded. In other embodiments, the tray 266 may be actively driven by an electric motor or similar arrangement to lower as the number of bound books supported on the tray 266 increases. Preferably, the tray 266 or the tray 266 and bin 268 are disposed within a drawer type of arrangement such that it/they may be pulled out from the machine 50 for easy access and removal of the bound books. It should be appreciated that the book stacking arrangement may include alternative structure(s). For example, the wheel 260 may be driven, or merely require a small amount of force to provide rotation. Alternatively, a funnel or a series baffles may be provided to place the bound book for stacking and removal. Bound books could also exit via a conveyor or a pusher mechanism.

Figure 24:
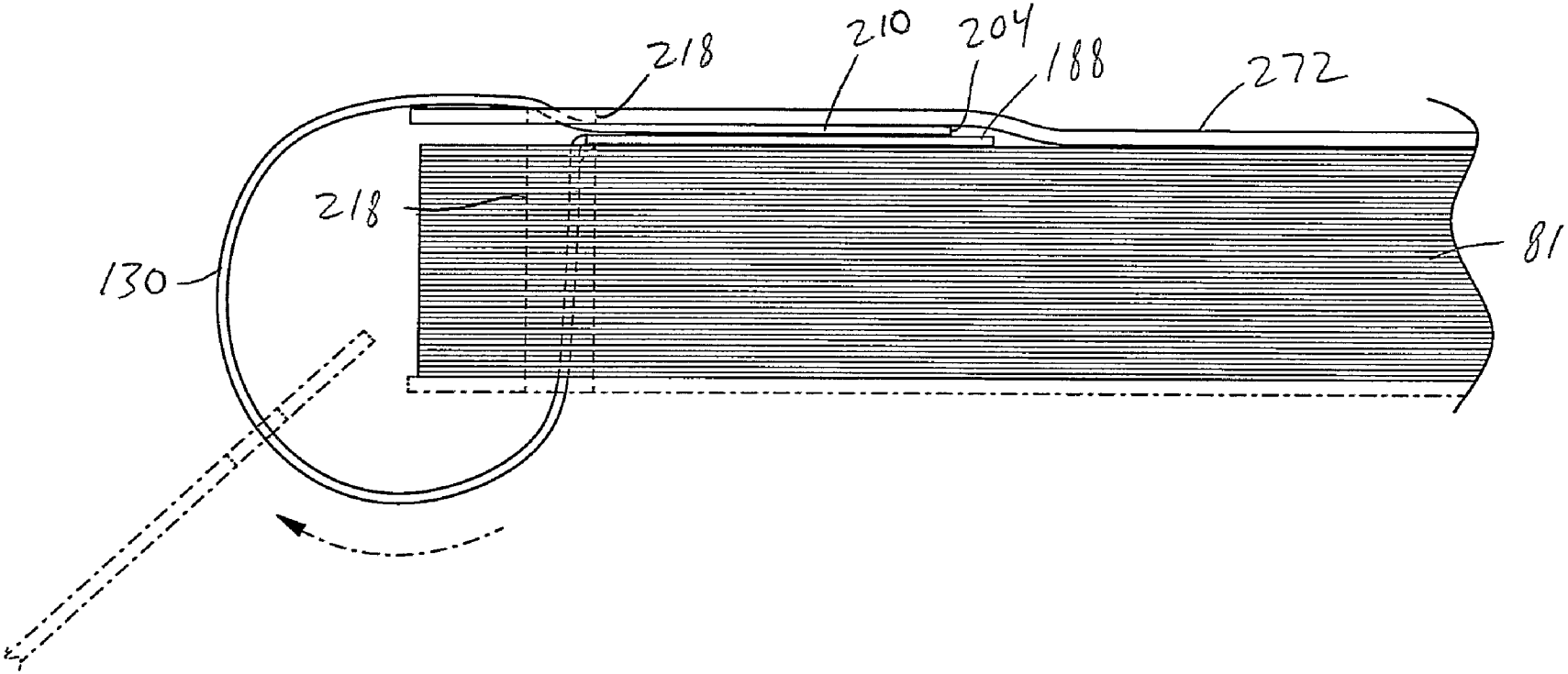
FIG. 24 is a perspective view of a back cover being folded over to cover the spine of the binding element.

With reference to FIGS. 22 and 23, a back cover 272 is positioned beneath the stack 81 of perforated sheets on the tray 72. The back cover 272 includes perforations 218 substantially similar to the perforations in the stack 81 of sheets, such that the perforations 218 in the back cover 272 are aligned with the perforations 218 in the stack 81 of sheets. With reference to FIG. 24, after the bound stack 81 of sheets is dropped into the bin 268, the back cover 272 is manually flipped over to sandwich the spine 188 and the tips 204 of the respective fingers 210 between the stack 81 of perforated sheets and the back cover 272. As such, the spine 188 and the tips 204 of the respective fingers 210 are hidden from view when the bound stack 81 of perforated sheets is handled by a reader.

It should be appreciated by those of skill in the art that the modules and subassemblies within the machine 50, as well as the particular design of the binding elements themselves, may be of an alternative configuration than those disclosed in the illustrations herein. While this invention has been described with an emphasis upon preferred embodiments, variations of the preferred embodiments can be used, and it is intended that the invention can be practiced otherwise than as specifically described herein. Accordingly, this invention includes all modifications encompassed within the spirit and scope of the invention as defined by the following claims. For example, various aspects of the invention may be practiced simultaneously. All of the references cited herein, including patents, patent applications, and publications, are hereby incorporated in their entireties by reference.

Various features of the invention are set forth in the following claims.

What is claimed is:

1. A method of binding a stack of perforated sheets using an automated binding machine, the method comprising:

providing a stack of binding elements, the binding elements being releasably interconnected to one another using an adhesive;

loading the binding elements into the automated binding machine;

after loading the binding elements into the automated binding machine, separating a first binding element from the plurality of binding elements; and binding the stack of perforated sheets using the separated first binding element;

wherein binding the stack of perforated sheets includes securing a first portion of the first binding element to a second portion of the first binding element, and wherein binding the stack of perforated sheets includes using the same adhesive that releasably interconnected the first binding element to the stack of binding elements to secure the first portion of the first binding element to the second portion of the first binding element.

2. The method of claim 1, wherein separating the first binding element from the plurality of binding elements includes separating a first end of the first binding element from the plurality of binding elements.

3. The method of claim 2, wherein separating the first binding element from the plurality of binding elements includes separating the first binding element from the first end of the first binding element to a second end of the first binding element.

4. The method of claim 1, wherein the plurality of binding elements includes a stack of generally planar binding elements.

5. The method of claim 1, further comprising bending the separated first binding element prior to binding the stack of perforated sheets.

6. The method of claim 5, further comprising forming a gusset in the first binding element prior to binding the stack of perforated sheets.

7. The method of claim 1, further comprising determining a thickness of the stack of perforated sheets.

8. The method of claim 7, wherein the stack of perforated sheets has a first thickness, the method further comprising binding a second stack of perforated sheets having a second thickness different from the first thickness with a second binding element separated from the plurality of binding elements.

9. The method of claim 7, wherein binding the stack of perforated sheets includes forming an appropriately-sized loop with the first binding element based on the determined thickness of the stack of perforated sheets.

10. The method of claim 1, wherein binding the stack of perforated sheets includes:

inserting a portion of the separated first binding element through the stack of perforated sheets; and engaging the inserted portion of the separated first binding element with a non-inserted portion of the separated first binding element.

11. The method of claim 10, wherein engaging the inserted portion with the non-inserted portion includes forming a loop with the inserted portion.

12. The method of claim 10, wherein engaging the inserted portion with the non-inserted portion includes using the adhesive.

13. The method of claim 10, wherein inserting the portion of the separated first binding element includes guiding the portion of the separated first binding element through perforations in the stack of separated sheets.

14. The method of claim 1, further comprising directly receiving the sheets from one of a printer and a copier.

15. An automated binding machine configured for binding a stack of perforated sheets with a binding element, the automated binding machine comprising:

a support member supporting the stack of perforated sheets;

a binding element feeder;

a stack of binding elements releasably interconnected to one another by an adhesive, the stack of binding elements supported by the binding element feeder;

a receiving member configured to receive a first binding element from the stack of binding elements and to insert at least a portion of the first binding element through the stack of perforated sheets; and a binding mechanism configured to engage the inserted portion and secure the inserted portion to a non-inserted portion of the first binding element using the same adhesive that releasably interconnected the first binding element to the stack of binding elements.

16. The automated binding machine of claim 15, wherein the binding mechanism forms a varying size loop in the first binding element depending on a thickness of the stack of perforated sheets.

17. The automated binding machine of claim 15, wherein the support member is movable with respect to the binding element feeder to accommodate stacks of perforated sheets having different thicknesses.

18. The automated binding machine of claim 15, further comprising a sensor configured to determine the thickness of the stack of perforated sheets.

19. The automated binding machine of claim 18, wherein the sensor communicates with at least one of the support member and the binding mechanism.

20. The automated binding machine of claim 15, wherein at least one of the support member and the binding mechanism is movable relative to the binding element feeder to form an appropriately-sized loop in the first binding element based on a determined thickness of the stack of perforated sheets.

21. The automated binding machine of claim 15, wherein the binding element feeder includes a suction member configured to at least partially separate the first binding element from the plurality of binding elements.

22. The automated binding machine of claim 15, wherein the binding element feeder includes a separator configured to at least partially separate the first binding element from the plurality of binding elements.

23. The automated binding machine of claim 22, wherein the separator includes a rotatable member having a projecting edge thereon configured to at least partially separate the first binding element from the plurality of binding elements.

24. The automated binding machine of claim 22, wherein the separator includes a linearly-movable member having a projecting edge thereon configured to at least partially separate the first binding element from the plurality of binding elements.

25. The automated binding machine of claim 15, wherein the binding element feeder includes an alignment member configured to position the stack of binding elements relative to the receiving member.

26. The automated binding machine of claim 15, further comprising at least one guide member configured to engage the first binding element during insertion of the first binding element into the stack of perforated sheets.

27. The automated binding machine of claim 15, further comprising a bending and gusseting mechanism configured to engage the first binding element to bend the first binding element and to form a gusset in the first binding element.

28. The automated binding machine of claim 27, wherein the bending and gusseting mechanism includes at least one of a male die and a female die, wherein the receiving member includes the other of the male die and the female die, and wherein the male die and the female die cooperate to form the gusset.

29. The automated binding machine of claim 15, wherein the binding mechanism is configured to form a loop in the first binding element.

30. The automated binding machine of claim 15, wherein the plurality of binding elements includes a stack of generally planar binding elements.

31. The automated binding machine of claim 15, wherein the automated binding machine directly receives the sheets from one of a printer and a copier.

* * * * *